US009752521B2

(12) United States Patent
Dudar

(10) Patent No.: US 9,752,521 B2
(45) Date of Patent: Sep. 5, 2017

(54) SYSTEM AND METHODS FOR COLD STARTING AN INTERNAL COMBUSTION ENGINE

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 14/859,018

(22) Filed: Sep. 18, 2015

(65) Prior Publication Data

US 2017/0082038 A1 Mar. 23, 2017

(51) Int. Cl.

| | |
|---|---|
| ***F02D 41/00*** | (2006.01) |
| ***F02D 41/06*** | (2006.01) |
| ***F02M 25/08*** | (2006.01) |
| *F02D 41/14* | (2006.01) |

(52) U.S. Cl.

CPC ..... *F02D 41/064* (2013.01); *F02D 41/0042* (2013.01); *F02D 41/0045* (2013.01); *F02D 41/1488* (2013.01); *F02M 25/0836* (2013.01); *F02D 41/1454* (2013.01)

(58) Field of Classification Search

CPC .. F02D 41/004; F02D 41/0042; F02D 41/064; F02M 25/0836

USPC ..... 123/516, 518–520

See application file for complete search history.

(56) References Cited

U.S. PATENT DOCUMENTS

| | | | |
|---|---|---|---|
| 5,482,017 | A | 1/1996 | Brehob et al. |
| 5,482,023 | A | 1/1996 | Hunt et al. |
| 5,894,832 | A | 4/1999 | Nogi et al. |
| 6,318,345 | B1 | 11/2001 | Weber et al. |
| 6,769,418 | B1 | 8/2004 | Reddy |
| 2013/0006507 | A1 | 1/2013 | Uhrich et al. |
| 2014/0074385 | A1 | 3/2014 | Dudar et al. |

*Primary Examiner* — Mahmoud Gimie

(74) *Attorney, Agent, or Firm* — James Dottavio; McCoy Russell LLP

(57) ABSTRACT

Methods and systems are provided for regulating a flow of fuel vapors from a fuel tank to an engine during an engine start. In one example, a method may comprise prior to a cold start of an engine: sealing a fuel tank from an evaporative emissions control system and an air intake of the engine, operating a fuel pump of the fuel tank to generate vapors in the fuel tank, and in response to fuel vapor levels in the fuel tank reaching a threshold, initiating cylinder combustion and flowing fuel vapors from the fuel tank to an intake manifold of the engine. The method may further comprise providing liquid fuel to the engine to initiate cylinder combustion.

20 Claims, 6 Drawing Sheets

SYSTEM AND METHODS FOR COLD STARTING AN INTERNAL COMBUSTION ENGINE

FIELD

The present disclosure relates to a controlling an evaporative emission control (EVAP) system in a vehicle system during an engine start.

BACKGROUND/SUMMARY

Internal combustion engine (ICE) starts are typically facilitated by a starter motor. The starter motor provides an initial crank to the engine, driving piston movement, and thereby creating suction to draw in a fuel and air mixture to one or more engine cylinders. Cylinder combustion may then be initiated once fuel is present in the cylinders and the pistons are reciprocating. Products of combustion may be treated by a catalytic converter to reduce emissions before being emitted to the atmosphere. However, catalytic converters must be heated to a sufficient temperature in order to adequately process the unwanted products of combustion.

During the start of a cold engine, engine emissions may be particularly high before the catalytic converter warms up enough to be effective. Further, liquid fuel may not vaporize as readily at lower temperatures, leading to increased amounts of unburnt hydrocarbons in the exhaust. In some examples, the volatility of cold liquid fuel may be so low, that even after cranking from the starter motor, the engine may fail to start. As such, a richer than stoichiometric (14.7:1) air to fuel mixture may be provided to the engine during a cold start to promote combustion. However, starting the engine with a rich air/fuel mixture may reduce fuel efficiency, and may increase hydrocarbon emissions due to incomplete burning of the hydrocarbons.

To reduce emissions during cold starts, several strategies have been developed to enhance heating of the catalytic converter. As one example, the exhaust system of an engine may be equipped with an Electrically Heated Catalyst (EHC). The EHC employs resistive elements which heat the catalyst prior to starting the engine. Other attempts have been made to adjust the fuel injection amount, fuel injection timing, and spark timing to increase exhaust gas temperatures so that the catalytic converter is heated more quickly. Once example approach is shown in U.S. Pat. No. 5,482,017 to Brehob et al., where the spark timing may be retarded during an engine start to increase exhaust gas temperatures and exhaust system components such as a catalytic converter. As another example, a more lean air/fuel mixture than stoichiometric may be injected during an engine start to create an exotherm in the catalyst and increase catalyst temperatures.

Other strategies to reduce emissions during cold starts include attempts to enhance hydrocarbon combustion efficiency, so that the exhaust gas mixture leaving the engine cylinders and entering the exhaust system is more depleted of uncombusted hydrocarbons. For example, U.S. Pat. No. 5,894,832 discloses a heating element which may be included in the intake system of an engine to pre-heat the fuel and air mixture before being delivered to one or more engine cylinders for combustion. After being heated, the fuel and air mixture may more readily combust, leading to a more complete burning of the hydrocarbons.

However, the inventors herein have recognized potential issues with such systems. As one example, electrically heated catalysts are more expensive and complex than traditional catalytic converters. Further, engine starting may be delayed to allow sufficient time for the EHC to be heated. Similarly, heating elements included in the intake to pre-heat the fuel and air mixture, add cost and complexity to the engine system. Retarding spark timing and adjusting fuel injection parameters during cold starts may reduce fuel efficiency, and in some cases, may increase emissions while the catalytic converter is heating up. For example, increasing the exhaust gas temperature by retarding spark timing or injecting a lean air/fuel mixture may produce elevated levels of NOx.

In one example, the issues described above may be addressed by a method comprising prior to a cold start of an engine: sealing a fuel tank from an evaporative emissions control system and an air intake of the engine, operating a fuel pump of the fuel tank to generate vapors in the fuel tank, and in response to fuel vapor levels in the fuel tank reaching a threshold, initiating cylinder combustion and flowing fuel vapors from the fuel tank to an intake manifold of the engine. In this way, emissions during engine starts may be reduced by purging fuel vapors from the fuel tank and/or canister to the intake manifold during the engine start. As explained above, the amount of liquid fuel injected during the engine start may be reduced by providing a portion of the fuel budget desired during an engine start in the form of fuel vapor. Since fuel vapors may combust more readily than liquid fuel, especially at lower ambient temperatures, the combustion efficiency of the engine during the start may be increased. That is to say, a more complete burning of hydrocarbons is achieved during an engine start. In this way, fewer unburnt hydrocarbons may be exhausted by the engine, therefore reducing emissions during the engine start. Spinning the fuel pump prior to the engine start may not only generate vapors in the fuel tank which may be used during an engine start, but it may also increase the temperature of the liquid fuel in the fuel tank. Since fuel vapors may combust more readily than liquid fuel, the success rate of engine starts may be improved by purging fuel vapors from the fuel tank to the intake manifold during the engine start and by increasing liquid fuel temperature.

In some examples, the method may additionally include injecting a desired starting amount of liquid fuel to the engine, and in response to opening of a canister purge valve, reducing the amount of liquid fuel injected to the engine based on an amount of fuel vapors flowing to the intake manifold, where the amount of liquid fuel injected to the engine is inversely proportional to the amount of fuel vapors flowing to the intake manifold. Prior to an exhaust oxygen sensor reaching a threshold temperature, the amount of fuel vapors flowing to the intake manifold may be estimated based on fuel vapor levels in the fuel tank and a vacuum level in the intake manifold as estimated based on outputs from a pressure sensor coupled to the intake manifold. After the exhaust oxygen sensor reaches the threshold temperature, the amount of fuel vapors flowing to the intake manifold may be estimated based on outputs from the exhaust oxygen sensor, and an amount of fuel provided to the engine may be adjusted by adjusting one or more of a fuel injection amount and/or the amount of fuel vapors flowing to the intake manifold, where the amount of fuel vapors flowing to the intake manifold may be adjusted by adjusting the position of a canister purge valve.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
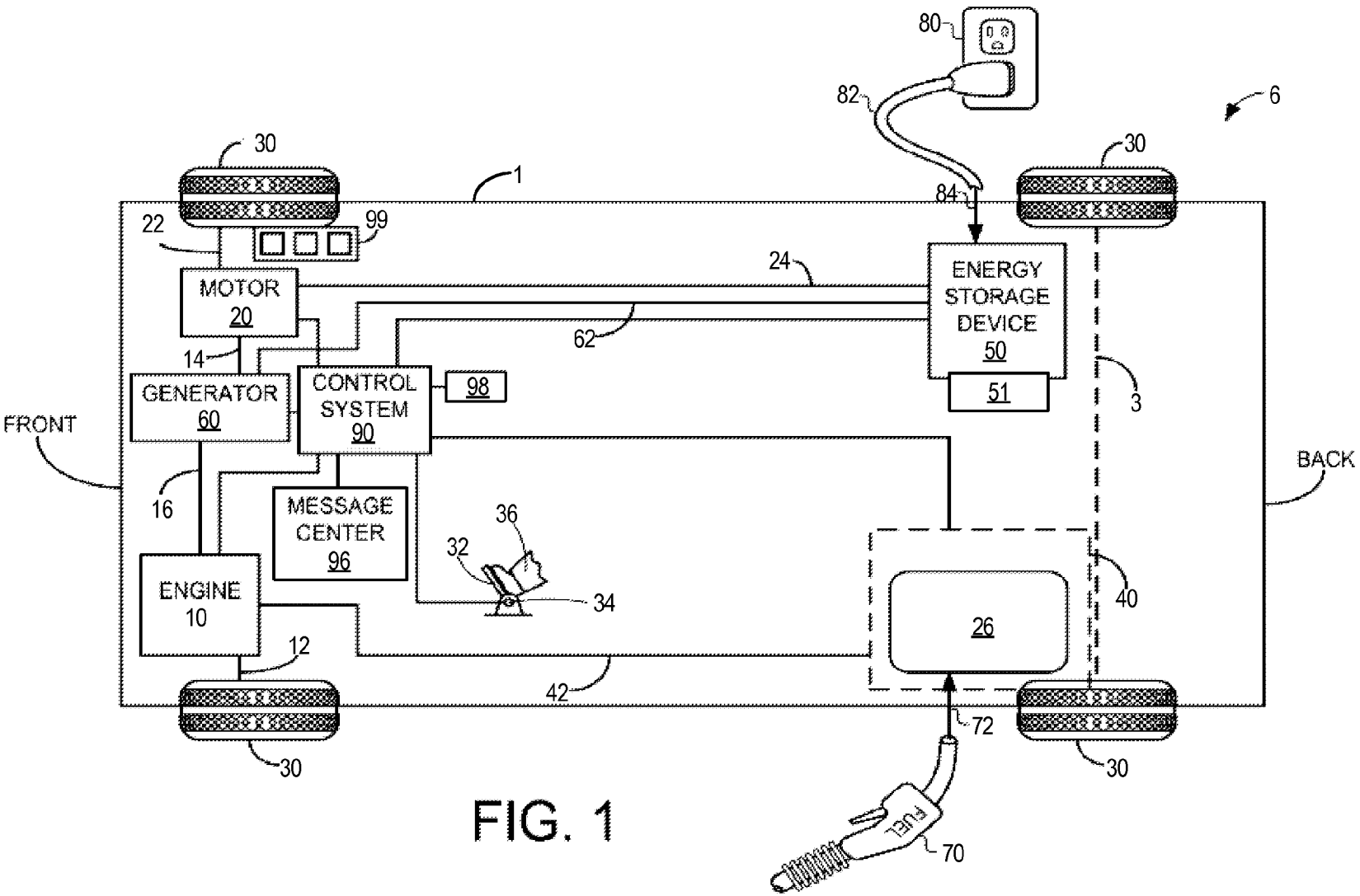
FIG. 1 shows a schematic diagram of an example vehicle system.
Figure 2A:
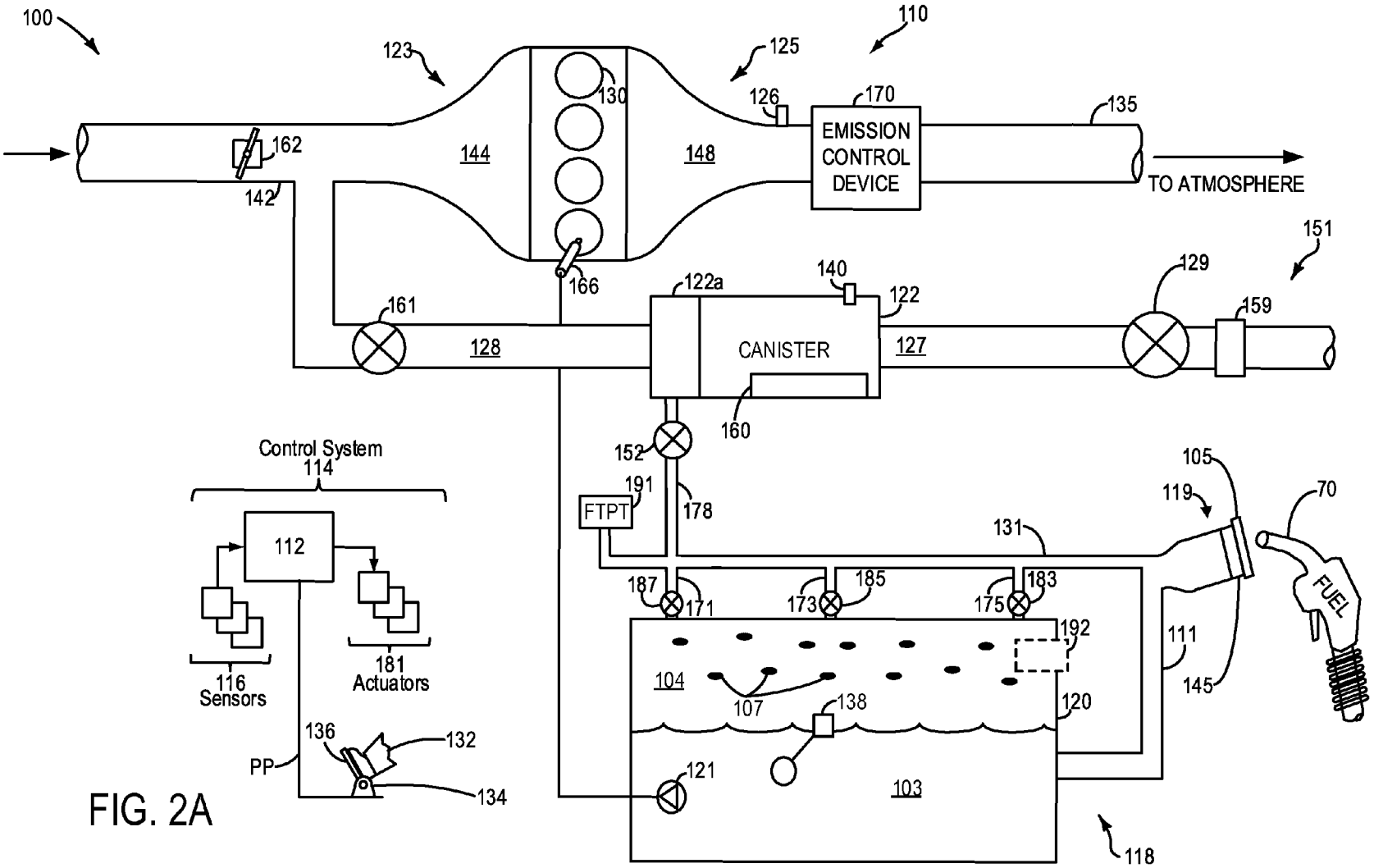
FIG. 2A shows a schematic diagram of an example engine system which may be included in the vehicle system of FIG. 1.
Figure 2B:
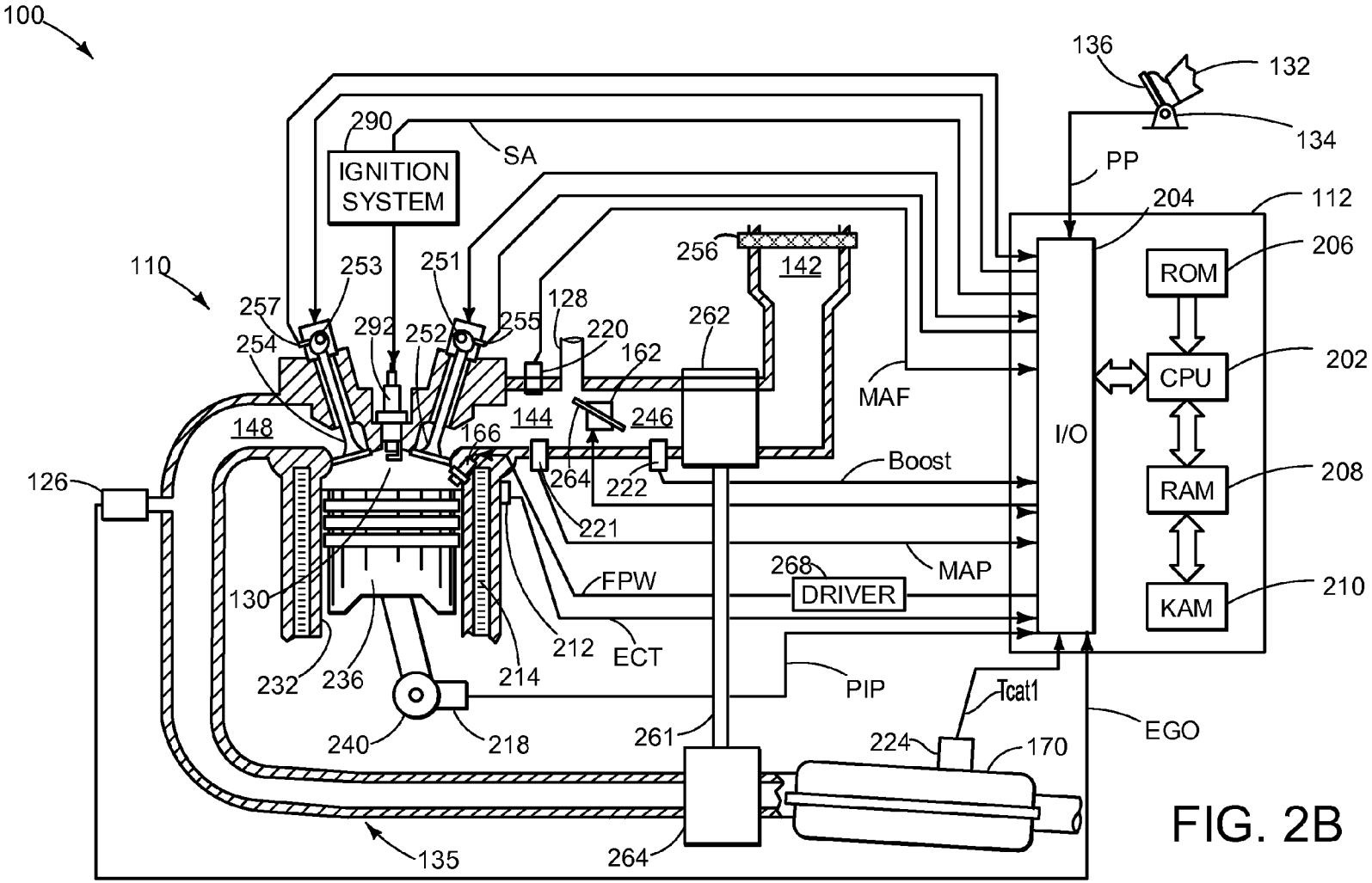
FIG. 2B shows a schematic diagram of one cylinder of the example engine system shown in FIG. 2A.
Figure 3:
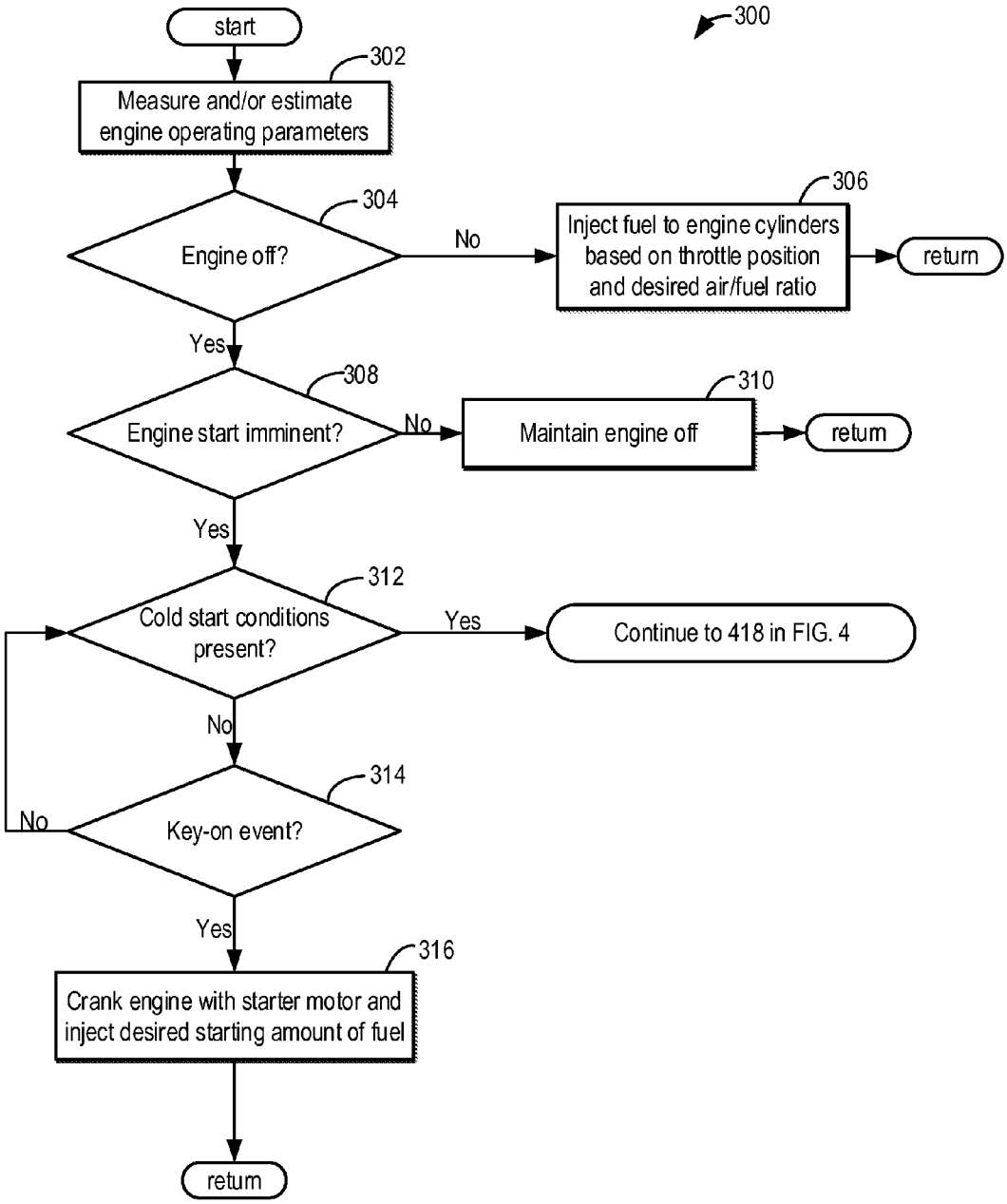
FIG. 3 shows a flow chart of an example method for determining if an engine cold start will occur.

The following description relates to systems and methods for regulating fuel vapor flow from a fuel tank to an intake manifold of an engine system, such as the engine system of FIGS. 2A-2B, during an engine start. The engine system may be included in a vehicle system, such as the vehicle system of FIG. 1. A vehicle operator may send signals to a controller of the vehicle system indicating that an engine start is imminent and/or desired. For example, the vehicle operator may set a desired vehicle temperature prior to entering the vehicle system and starting the engine. In another example, the vehicle operator may set a timer, specifying a countdown to engine start time. Responsive to an indication that an engine start is imminent, the controller may determine if cold start conditions exist. An example method for determining if cold start conditions exist is shown in FIG. 3. If cold start conditions exist, a fuel pump of a fuel tank of the vehicle system may be powered on prior to the engine start as described in the example method shown in FIG. 4.

Figure 5:
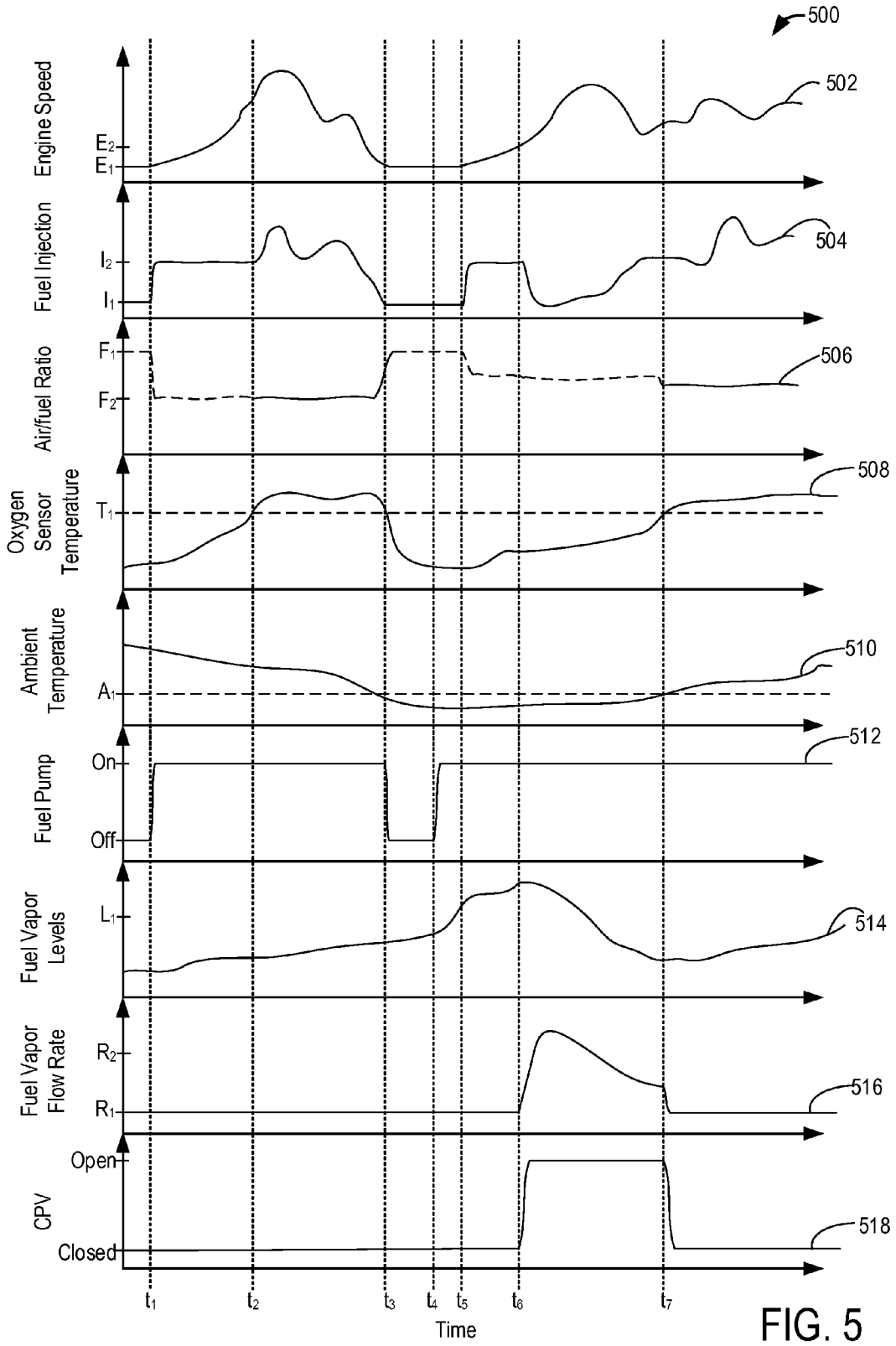
FIG. 5 is a graph depicting adjustments to a fuel injection amount and/or a purge flow rate from an EVAP system under varying engine operating conditions.

Powering on the fuel pump prior to the engine start may cause fuel vapors to be generated in the fuel tank. Fuel vapors stored in the fuel tank and/or a fuel vapor canister may then be purged to the intake manifold during an engine start to increase combustion efficiency. FIG. 5 shows changes in the fuel vapor flow rate to the intake manifold under varying engine operating conditions. Since fuel vapors may combust more readily than liquid fuel, particularly at colder ambient temperatures, a more complete burning of hydrocarbons may be achieved during an engine start. As such, emissions during an engine start may be reduced.

FIG. 1 illustrates an example vehicle system 6 as shown from a top view. Vehicle system 6 includes a vehicle body 1 with a front end, labeled "FRONT", and a back end labeled "BACK." Vehicle system 6 may include a plurality of wheels 30. For example, as shown in FIG. 1, vehicle system 6 may include a first pair of wheels adjacent to the front end of the vehicle and a second pair of wheels adjacent the back end of the vehicle. Forward motion of the vehicle should be understood to mean motion of the vehicle toward the front end of the vehicle and backward motion of the vehicle should be understood to mean motion of the vehicle toward the back end of the vehicle.

Vehicle system 6 includes a fuel burning engine 10 and a motor 20. More detailed examples of engine 10 are shown below with reference to FIGS. 2A-2B. As a non-limiting example, engine 10 comprises an internal combustion engine and motor 20 comprises an electric motor. Motor 20 may be configured to utilize or consume a different energy source than engine 10. For example, engine 10 may consume a liquid fuel (e.g., gasoline) to produce an engine output while motor 20 may consume electrical energy to produce a motor output. As such, the vehicle system 6 may be referred to as a hybrid electric vehicle (HEV).

Vehicle system 6 may utilize a variety of different operational modes depending on operating conditions encountered by the vehicle propulsion system. Some of these modes may enable engine 10 to be maintained in an off state (i.e. set to a deactivated state) where combustion of fuel at the engine is discontinued. For example, under select operating conditions, motor 20 may propel the vehicle via drive wheel 30 as indicated by line 22 while engine 10 is deactivated.

During other operating conditions, engine 10 may be set to a deactivated state (as described above) while motor 20 may be operated to charge energy storage device 50. For example, motor 20 may receive wheel torque from drive wheel 30 as indicated by line 22 where the motor may convert the kinetic energy of the vehicle to electrical energy for storage at energy storage device 50 as indicated by line 24. This operation may be referred to as regenerative braking of the vehicle. Thus, motor 20 can provide a generator function in some embodiments. However, in other embodiments, generator 60 may instead receive wheel torque from drive wheel 30, where the generator 60 may convert the kinetic energy of the vehicle to electrical energy for storage at energy storage device 50 as indicated by line 62. The generator 60 may additionally receive torque output from engine 10 as indicated by line 16, and may convert the rotational motion provided from the engine 10 to electrical energy for storage at energy storage device 50 as indicated by line 62.

During still other operating conditions, engine 10 may be operated by combusting fuel received from fuel system 40 as indicated by line 42. For example, engine 10 may be operated to propel the vehicle via drive wheel 30 as indicated by line 12 while motor 20 is deactivated. During other operating conditions, both engine 10 and motor 20 may each be operated to propel the vehicle via drive wheel 30 as indicated by lines 12 and 22, respectively. A configuration where both the engine and the motor may selectively propel the vehicle may be referred to as a parallel type vehicle propulsion system. Note that in some embodiments, motor 20 may propel the vehicle via a first set of drive wheels and engine 10 may propel the vehicle via a second set of drive wheels.

In other embodiments, vehicle propulsion system 6 may be configured as a series type vehicle system, whereby the engine does not directly propel the drive wheels. Rather, engine 10 may be operated to power motor 20, which may in turn propel the vehicle via drive wheel 30 as indicated by line 22. For example, during select operating conditions, engine 10 may drive generator 60, which may in turn supply electrical energy to one or more of motor 20 as indicated by line 14 or energy storage device 50 as indicated by line 62. As another example, engine 10 may be operated to drive motor 20 which may in turn provide a generator function to convert the engine output to electrical energy, where the electrical energy may be stored at energy storage device 50 for later use by the motor. As yet another example, engine 10 may be operated to drive generator 60, which may in turn provide a generator function to convert the engine output to electrical energy, where the electrical energy may be stored at energy storage device 50 for later use by the motor. The vehicle propulsion system may be configured to transition between two or more of the operating modes described above depending on operating conditions.

Fuel system 40 may include one or more fuel tanks such as fuel tank 26 for storing fuel on-board the vehicle. For example, fuel tank 26 may store one or more liquid fuels, including but not limited to: gasoline, diesel, and alcohol fuels. In some examples, the fuel may be stored on-board the vehicle as a blend of two or more different fuels. For example, fuel tank 26 may be configured to store a blend of gasoline and ethanol (e.g., E10, E85, etc.) or a blend of gasoline and methanol (e.g., M10, M85, etc.), whereby these fuels or fuel blends may be delivered to engine 10 as indicated by line 42. Still other suitable fuels or fuel blends may be supplied to engine 10, where they may be combusted at the engine to produce an engine output. The engine output may be utilized to propel the vehicle as indicated by line 12 or to recharge energy storage device 50 via motor 20 or generator 60.

In some examples, as shown in FIG. 1, fuel tank 26 may be packaged in the vehicle adjacent to a wheel axle, e.g., adjacent to wheel axle 3 towards the back side of the vehicle. However, in other examples, fuel tank 26 may be positioned in another region of the vehicle, e.g., adjacent to a front axle or other location.

In some embodiments, energy storage device 50 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 50 may include one or more batteries and/or capacitors. For example, the energy storage device 50 may be any suitable battery such as lithium-ion, lead acid, lead antimony, solid polymer electrolyte, molten salt, etc.

In some examples, the energy storage device 50 may also be configured as a starter battery, used to provide energy to a starter, which in some examples may be motor 20, to crank the engine 10 during an engine start. However, in other examples, the vehicle system 6 may include a separate starter battery in addition to the energy storage device 50 to provide power to the starter (e.g., motor 20) for cranking the engine 10 during an engine start. In this way, motor 20 may be configured to convert electrical energy provided from the energy storage device 50 into rotational mechanical energy for cranking the engine 10 during an engine start.

Control system 90 may communicate with one or more of engine 10, motor 20, fuel system 40, energy storage device 50, and generator 60. Control system 90 may receive sensory feedback information from one or more of engine 10, motor 20, fuel system 40, energy storage device 50, and generator 60. Further, control system 90 may send control signals to one or more of engine 10, motor 20, fuel system 40, energy storage device 50, and generator 60 responsive to this sensory feedback. Control system 90 may receive input from a vehicle operator 36 via an input device. For example, control system 90 may receive sensory feedback from pedal position sensor 34 which communicates with input device 32. Input device 32 may refer schematically to a brake pedal and/or an accelerator pedal.

Energy storage device 50 may periodically receive electrical energy from a power source 80 residing external to the vehicle (e.g., not part of the vehicle). As a non-limiting example, vehicle system 6 may be configured as a plug-in hybrid electric vehicle (PHEV), whereby electrical energy may be supplied to energy storage device 50 from power source 80 via an electrical energy transmission cable 82. Thus, transmission cable 82 may transmit electrical power from the power source 80 to the energy storage device 50 as shown by electrical flow arrow 84. During a recharging operation of energy storage device 50 from power source 80, electrical transmission cable 82 may electrically couple energy storage device 50 and power source 80. While the vehicle propulsion system is operated to propel the vehicle, electrical transmission cable 82 may be disconnected between power source 80 and energy storage device 50. Control system 90 may identify and/or control the amount of electrical energy stored at the energy storage device 50, which may be referred to as the state of charge (SOC). Specifically, the energy storage device 50 may include a state of charge indicator 51, which may provide an indication of the state of charge of the energy storage device 50 to the control system 90. The state of charge indicator 51 may be any suitable device for measuring the charge state of the battery, such as an equivalent series resistance (ESR) meter, voltmeter, ammeter, etc.

In other embodiments, electrical transmission cable 82 may be omitted, where electrical energy may be received wirelessly at energy storage device 50 from power source 80. For example, energy storage device 50 may receive electrical energy from power source 80 via one or more of electromagnetic induction, radio waves, and electromagnetic resonance. As such, it should be appreciated that any suitable approach may be used for recharging energy storage device 50 from a power source that does not comprise part of the vehicle. In this way, motor 20 may propel the vehicle by utilizing an energy source other than the fuel utilized by engine 10.

Fuel system 40 may periodically receive fuel from a fuel source residing external to the vehicle. As a non-limiting example, vehicle system 6 may be refueled by receiving fuel via a fuel dispensing nozzle 70 as indicated by line 72. In some embodiments, fuel tank 26 may be configured to store the fuel received from fuel dispensing nozzle 70 until it is supplied to engine 10 for combustion. In some embodiments, control system 90 may receive an indication of the level of fuel stored at fuel tank 26 via a fuel level sensor as described in greater detail below with reference to FIG. 2A. The level of fuel stored at fuel tank 26 (e.g., as identified by the fuel level sensor) may be communicated to the vehicle operator, for example, via a fuel gauge or indication lamp indicated displayed on a message center 96. The message center include any suitable display such as LED, LCD, plasma, etc., for present visual information to the vehicle operator 36.

Vehicle system 6 may be configured to utilize a secondary form of energy (e.g., electrical energy) that is periodically received from an energy source that is not otherwise part of the vehicle.

The vehicle system 6 may also include ambient temperature/humidity sensor 98, and a roll stability control sensor, such as a lateral and/or longitudinal and/or yaw rate sensor(s) 99. The message center 96 may include indicator light(s) and/or a text-based display in which messages are displayed to an operator, such as a message requesting an operator input to start the engine, as discussed below. The message center may also include various input portions for receiving an operator input, such as buttons, touch screens, voice input/recognition, etc. In an alternative embodiment, the message center may communicate audio messages to the operator without display.

It should be understood that although FIG. 1 shows a plug-in hybrid electric vehicle, in other examples, vehicle system 6 may be a hybrid vehicle without plug-in components. Further, in other examples, vehicle system 6 may not be a hybrid vehicle but may be another type of vehicle with other propulsion mechanisms, e.g., a vehicle with a gasoline engine or a diesel engine which may or may not include other propulsion systems. Thus, in some examples, vehicle system 6 may be powered by only by engine 10, and not by energy storage device 50 and/or motor 20.

FIGS. 2A and 2B show schematic depictions of an engine system 100. Engine system 100 may be the same or similar to engine 10 shown above with reference to FIG. 1. As such, it should be appreciated that engine system 100 may be included in an on-road vehicle system such as the vehicle system 6 shown above with reference to FIG. 1. Thus, engine system 100 may be included in a HEV or PHEV. However, in other examples, engine system 100 may be included in a vehicle with only a gasoline engine that may not include another type of propulsion system. FIG. 2A shows the engine system 100 coupled to an evaporative emissions control (EVAP) system 151 and a fuel system 118, which may be the same or similar to fuel system 40 shown above with reference to FIG. 1. EVAP system 151 may include a fuel vapor container or canister 122 which may be used to capture and store fuel vapors. FIG. 2B, shows a more detailed depiction of one cylinder of the engine system 100.

Turning now to FIG. 2A, the engine system 100 may be controlled by a controller 112 and/or input from a vehicle operator 132 via an input device 136. The input device 136 may be the same or similar to input device 32 described above with reference to FIG. 1. As such, the input device 136 may comprise an accelerator pedal and/or a brake pedal. A position sensor 134 may be coupled to the input device 136, for measuring a position of the input device 136, and outputting a pedal position (PP) signal to the controller 112. As such, output from the position sensor 134 may be used to determine the position of the accelerator pedal and/or brake pedal of the input device 136, and therefore determine a desired engine torque. Thus, a desired engine torque as requested by the vehicle operator 132 may be estimated based on the pedal position of the input device 136.

The engine system 100 may include an engine 110 having a plurality of cylinders 130. A more detailed schematic of one cylinder of the engine 110 is shown below with reference to FIG. 2B. The engine 110 includes an engine intake 123 and an engine exhaust 125. The engine intake 123 includes a throttle 162 fluidly coupled to the engine intake manifold 144 via an intake passage 142. The throttle 162 may be in electrical communication with a controller 112, and as such may be an electronically controlled throttle. Said another way, the controller 112, may send signals to an actuator of the throttle 162, for adjusting the position of the throttle 162. The position of the throttle 162 may be adjusted based on one or more of a desired engine torque, desired air/fuel ratio, barometric pressure, etc. In response to changes in the desired engine torque as determined based on changes in the position of the input device 136, the controller 112 may adjust the position of throttle 162, and/or fuel injectors of engine 110 to achieve the desired engine torque while maintaining a desired air/fuel ratio. Further, in examples where in the intake includes a compressor such as a turbocharger or supercharger, the position of the throttle 162 may be adjusted based on an amount of boost in the intake passage 142. An example where engine 110 includes a turbocharger is shown below with reference to FIG. 2B.

The engine exhaust 125 includes an exhaust manifold 148 leading to an exhaust passage 135 that routes exhaust gas to the atmosphere. The atmosphere includes the ambient environment surrounding the vehicle, which may have an ambient temperature and pressure (such as barometric pressure). The engine exhaust 125 may include an oxygen sensor 126, coupled to the exhaust passage 135 upstream of an emission control device 170. The emission control device 170 is shown arranged along the exhaust passage 135 downstream of the oxygen sensor 126. The device 170 may be a three way catalyst (TWC), NOx trap, diesel particulate filter, oxidation catalyst, various other emission control devices, or combinations thereof. As such, emission control device 170 may also be referred to herein as catalyst 170. In some embodiments, during operation of engine 110, emission control device 170 may be periodically reset by operating at least one cylinder of the engine within a particular air/fuel ratio.

The oxygen sensor 126 may be any suitable sensor for providing an indication of exhaust gas air/fuel ratio such as universal or wide-range exhaust gas oxygen (UEGO) sensor. However, the oxygen sensor 126 may be any other suitable oxygen sensor such as a linear oxygen sensor, lambda sensor, a two-state oxygen sensor or EGO, or a HEGO (heated EGO). In this way, the oxygen sensor 126 may be used to estimate and/or measure the oxygen content of exhaust gas exhausted from the engine 110 prior to treatment by the emission control device 170. Changes in the exhaust gas oxygen concentration may be caused by changes in the air/fuel ratio of the gas mixture in the cylinders 130. Thus, an air/fuel ratio may be estimated by the controller 112 based on changes in the exhaust gas oxygen concentration as estimated based on outputs from the oxygen sensor 126.

The controller 112 may adjust an amount of fuel injected to one or more of the engine cylinders 130 by via fuel injectors such as fuel injector 166 based on a desired air/fuel ratio and the estimated air/fuel ratio determined based on outputs from the oxygen sensor 126. Specifically, the controller 112 may send signals to the fuel injector 166 to adjust an amount of fuel injected to one or more of the engine cylinder 130 based on a difference between the estimated air/fuel ratio and the desired air/fuel ratio. The desired air/fuel ratio may be stoichiometric (e.g., an air to fuel ratio of 14.7:1). However, the desired air/fuel ratio may depend on engine operating conditions. While only a single injector 166 is shown in FIG. 2A, it should be appreciated that additional injectors are provided for each cylinder of the engine 110.

The fuel injectors, such as fuel injector 166, may receive fuel from a fuel system 118. Fuel system 118 may include a fuel tank 120 including a fuel pump 121. The fuel pump 121 may be configured to pressurize and deliver fuel to the injectors of engine 110, such as the example injector 166 shown in FIG. 2A. It will be appreciated that fuel system 118 may be a return-less fuel system, a return fuel system, or various other types of fuel system. Fuel tank 120 may the same as or similar to fuel tank 26 described above with reference to FIG. 1, and as such may hold a plurality of fuel blends, including fuel with a range of alcohol concentrations, such as various gasoline-ethanol blends, including E10, E85, gasoline, etc., and combinations thereof. A fuel level sensor 138 located in fuel tank 120 may provide an indication of the fuel level ("Fuel Level Input") to controller 112. As depicted, fuel level sensor 138 may comprise a float connected to a variable resistor. Alternatively, other types of fuel level sensors may be used. Thus, during a refueling event, outputs from the fuel level sensor 138 may be used to estimate a mass flow rate of fuel being added to the tank 120.

Fuel tank 120 may be partially filled with liquid fuel 103, but a portion of the liquid fuel 103 may evaporate over time, producing fuel vapors 107 in an upper dome portion 104 of the tank 120. The amount of fuel vapors 107 produced may depend upon one or more of the ambient temperature, fuel level, and positions of valves 183, 185, and 187. For example, an amount of fuel vapors 107 in the fuel tank 120 may increase with increasing ambient temperatures, as warmer temperatures may result in increased evaporation of fuel 103 in the fuel tank 120.

In other examples, vapors 107 may be generated when the fuel pump 121 is turned on and a turbine of the fuel pump is spinning. As explained below with reference to FIGS. 3 and 4, the fuel pump 121 may be turned on prior to and/or during an engine start to increase fuel vapor generation. Specifically, depending on ambient conditions, the controller 112 may send signals to the fuel pump 121 to power on, prior to and/or during an engine start, to increase vapor generation. Vapors generated from the spinning fuel pump 121, may be directed to the intake manifold 144 to reduce emissions of pollutants such as hydrocarbons and NOx during an engine start.

A fuel tank pressure sensor (FTPT) 191 may be physically coupled to the fuel tank 120 for measuring and/or estimating the pressure in the fuel tank 120. Specifically, FTPT 191 may be in electrical communication with controller 112, where outputs from the FTPT 191 may be used to estimate a pressure in the fuel tank 120. Further, an amount of fuel vapors in the fuel tank 120 may be estimated based on the pressure in the fuel tank 120 and/or the fuel level in the fuel tank 120 as estimated based on outputs from fuel level sensor 138. Specifically, the fuel tank pressure may increase for increases in one or more of an amount of fuel vapors 107 in the fuel tank 120, and/or an amount of fuel in the tank 120. In the example shown in FIG. 2A, the FTPT 191 may be positioned between the fuel tank 120 and the canister 122. However in other examples, the FTPT 191 may be coupled directly to the fuel tank 120. In still further examples the FTPT may be coupled directly to the canister 122.

In another example, the fuel tank 120 may optionally include a hydrocarbon sensor 192 for estimating an amount of fuel vapors 107 in the fuel tank 120. Thus, the controller 112 may estimate an amount of fuel vapors 107 in the fuel tank 120 based on signals received from the hydrocarbon sensor 192. The hydrocarbon sensor 192 may be any suitable hydrocarbon sensor for measuring hydrocarbon levels, such as catalytic, photo-ionization, infra-red, gas chromatography, and flame ionization.

Vapors generated in fuel system 118 may be routed to the evaporative emissions control system (EVAP) 151, which includes fuel vapor canister 122, via vapor storage line 178, before being purged to the engine intake 123 via purge line 128. Vapor storage line 178 may be coupled to fuel tank 120 via one or more conduits and may include one or more valves for isolating the fuel tank during certain conditions. For example, vapor storage line 178 may be coupled on a first end to fuel tank 120 via one or more or a combination of conduits 171, 173, and 175. Further, the vapor storage line 178 may be coupled on an opposite second end to the canister 122, specifically buffer 122*a*, for providing fluidic communication between the fuel tank 120 and the canister 122.

The fuel tank 120 may include one or more vent valves, which may be disposed in conduits 171, 173, or 175. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 171 may include a first grade vent valve (GVV) 187, conduit 173 may include a fill limit venting valve (FLVV) 185, and conduit 175 may include a second grade vent valve (GVV) 183.

In some examples, the flow of air and vapors between fuel tank 120 and canister 122 may be regulated by a fuel tank isolation valve (FTIV) 152. Thus, FTIV 152 may control venting of fuel tank 120 to the canister 122. FTIV 152 may be a normally closed valve, that when opened, allows for the venting of fuel vapors from fuel tank 120 to canister 122.

Emissions control system 151 may include fuel vapor canister 122. Canister 122 may be filled with an appropriate adsorbent, and may be configured to temporarily trap fuel vapors (including vaporized hydrocarbons) from the fuel system 118. In one example, the adsorbent used in the canister 122 may be activated charcoal. Emissions control system 151 may further include canister ventilation path or vent line 127 which may provide fluidic communication between canister 122 and the atmosphere. Vent line 127 may be coupled on a first end to the canister 122, and may be open to the atmosphere on an opposite second end. A canister vent valve (CVV) 129 may be positioned within the vent line 127, and may be adjusted to a closed position to fluidically seal the canister 122 from the atmosphere. However, during certain engine operating conditions, such as during purging operations, the CVV 129 may be opened to allow fresh, ambient air through the vent line 27 and into the canister 122, to increase fuel vapor desorption in the canister 122. In other examples, the CVV 129 may be opened during fuel vapor storing operations (for example, during fuel tank refueling and while the engine is not running) so that air, stripped of fuel vapor after having passed through the canister 122, can be pushed out to the atmosphere. In some examples, vent line 127 may additionally include an air filter 159 disposed therein, upstream of canister 122. The air filter 159 may be positioned between the CVV 129 and the atmosphere for filtering air flowing out of the vent 127 to the atmosphere, and/or filtering air flowing into the canister 122 from the atmosphere.

Canister 122 may include a buffer 122*a* (or buffer region), each of the canister and the buffer 122*a* comprising the adsorbent. As shown, the volume of buffer 122*a* may be smaller than (e.g., a fraction of) the volume of canister 122. The adsorbent in the buffer 122*a* may be same as, or different from, the adsorbent in the canister (e.g., both may include charcoal). Buffer 122*a* may be positioned within canister 122 such that during canister loading, fuel tank vapors are first adsorbed within the buffer 122*a*, and then when the buffer is saturated, further fuel tank vapors are adsorbed in the canister 122. In comparison, during canister purging, fuel vapors are first desorbed from the canister 122 (e.g., to a threshold amount) before being desorbed from the buffer 122*a*. In other words, loading and unloading of the buffer 122*a* is not linear with the loading and unloading of the canister 122. As such, the effect of the canister buffer 122*a* is to dampen any fuel vapor spikes flowing from the fuel tank 120 to the canister 122, thereby reducing the possibility of any fuel vapor spikes going to the engine 110.

Fuel vapors stored in the canister 122, may be vented to atmosphere, or purged to engine intake system 123 via canister purge valve (CPV) 161. The CPV 161 may be positioned in purge line 128 between the canister 122 and the intake manifold 144 for regulating to the flow of fuel vapors from the canister 122 to the intake manifold 144. Specifically, during a purging operation, the canister vent valve (CVV) 129 and the CPV 161 may be opened to allow fresh, ambient air to flow through the canister 122. Fuel vapors in the canister 122 may be desorbed as fresh air flows through the canister 122, and the desorbed fuel vapors may be purged to the intake manifold 144 via purge line 128 due to the vacuum generated in the intake manifold 144 during engine operation. In some examples, during purging of the canister 122, the FTIV 152 may additionally be opened so that fuel vapors from both the fuel tank 120 and the canister 122 may be purged to the intake manifold 144.

Canister 122 may additionally include a heater 160 for heating the canister 122. In some examples, the heater 160 may be powered by a vehicle battery (e.g., energy storage device 50 shown in FIG. 1). However, in other examples, the heater 160 may include its own battery or other power source. The heater 160 may be powered on prior to and/or during purging of fuel vapors from the canister 122 to increase hydrocarbon desorption from the canister 122. Thus, an amount of hydrocarbons flowing to the intake manifold 144 upon opening of the CPV 161 may be increased by heating the canister 122 with the heater 160.

Fuel vapor levels in the canister 122 may also be referred to as an amount of canister loading. Thus, canister loading increases with increasing levels of fuel vapors stored in the canister 122. Canister loading may be estimated based on outputs from one or more sensors. In the example of FIG. 1, a temperature sensor 140 may be coupled to the canister 122 for measuring an amount fuel vapor levels in the canister 122. Specifically, outputs from the sensor 140 corresponding to a temperature in the canister 122 may be used to infer an amount of fuel vapors stored in the canister 122. Increases in fuel vapors levels in the canister 122 may cause increases in the temperature of the canister 122, and as such a relationship may be established between canister temperatures and canister loading. However, in other examples, the fuel vapor levels may be estimated based on outputs from a pressure sensor, where fuel vapor levels may increase with increasing pressure levels. In still further examples, the sensor 140 may be a hydrocarbon sensor, and an amount of fuel vapors in the canister 122 may be estimated based on outputs from the hydrocarbon sensor. In yet further examples, the amount of fuel vapors in the fuel tank may be determined from one or more of the pressure in the tank, a rate of change of pressure in the tank, a fuel level in the tank, a temperature of the tank, and/or an indication of a concentration of fuel vapors in the tank.

Fuel system 118 and/or EVAP system 151 may be operated by controller 112 in a plurality of modes by selective adjustment of the various valves and solenoids. One or more of valves 129, 152, and 161 may be normally closed valves. For example, prior to an engine start, the fuel system 118 and/or EVAP system 151 may be operated in a fuel vapor generation mode. In the fuel vapor generation mode, the controller 112 may send signals to the CVV 129, FTIV 152, and CPV 161 to command the valves to close, fluidically sealing the fuel tank 120 from the EVAP system 151 prior to an engine start. Specifically, as described below with reference to FIGS. 3 and 4, the fuel pump 121 may be turned on, and the CVV 129, FTIV 152, and CPV 161 may be closed prior to an engine start, and/or during a portion of an engine start to generate vapors in the fuel tank 120. Thus, by closing the CVV 129, FTIV 152, and CPV 161, and powering on the pump 121, an amount of fuel vapors 107 in the fuel tank 120 may be increased. Excess fuel vapors may then be routed from the fuel tank 120 and/or canister 122 to the intake manifold 144 during an engine start to reduce emissions.

Specifically, the fuel system 118 and/or EVAP system 151 may be operated in a cold start emission control mode during an engine start, where in response to the fuel vapor levels in the fuel tank 120 reaching a threshold, the controller 112 may send signals to the CVV 129, FTIV 152, and CPV 161 to open. Opening the CVV 129, FTIV 152, and CPV 161 during the engine start may purge fuel vapors from one or more of the fuel tank 120 and canister 122 to the intake manifold 144. By routing fuel vapors to the intake manifold 144 during an engine start, the amount of fuel injected to the engine cylinders 130 by the fuel injectors may be reduced. Because fuel vapors may combust more easily than liquid fuel, the combustion efficiency of the engine 110 may be increased during an engine start. Specifically, the proportion of hydrocarbons burned during an engine stroke may be increased due to increases in the amount of fuel vapors purged to the intake manifold 144 and decreases in the amount of liquid fuel delivered to the engine 110 by the fuel injectors. As a result, emissions during an engine start may be reduced.

Additionally or alternatively, the fuel system 118 may be operated in a fuel vapor storage mode (e.g., during a fuel tank refueling operation), wherein the controller 112 may open isolation valve 152 while closing canister purge valve (CPV) 161 and/or CVV 129 to direct refueling vapors into canister 122 while preventing fuel vapors from being directed into the intake manifold and/or to the atmosphere. The controller 112 may open the FTIV 152 to vent fuel vapors from the fuel tank 120 to the canister 122 for absorption therein. However, during the fuel vapor storage mode canister purging may not be desired, and thus the CPV 161 may be closed to ensure that fuel vapors from the tank 120 flow only to the canister 122 and not the intake manifold 144. Canister purging may not be desired under a variety of conditions such as when the engine is off, when fuel vapor levels in the canister 122 are less than threshold, or when the intake manifold 144 cannot ingest the excess hydrocarbons that would be introduced upon opening of the CPV 161.

Thus, based on one or more of the estimated fuel vapor levels in the canister 122 and fuel tank 120, vacuum level in the intake manifold 144, and a desired purge flow rate, the controller 112, may adjust the position of valves 161 and 129 and 152. In some examples valves 161, 129 and 152 may be actively controlled valves, and may each be coupled to an actuator (e.g., electromechanical, pneumatic, hydraulic, etc.), where each actuator may receive signals from the controller 112 to adjust the position of its respective valve. However, in other examples, the valves may not be actively controlled, and instead may be passively controlled valves, where the position of the valves may change in response to changes in pressure, temperature, etc., such a wax thermostatic valve.

In examples where the valves 161, 129, and 152 are actively controlled, the valves 161, 129, and 152 may be binary valves, and the position of the valves may be adjusted between a fully closed first position and a fully open second position. However in other examples, the valves 161, 129, and 152 may be continuously variable valves, and may be adjusted to any position between the fully closed first position and fully open second position. Further, the actuators may be in electrical communication with the controller 112, so that electrical signals may be sent between the controller 112 and the actuators. Specifically, the controller may send signals to the actuators to adjust a position of the valves 161, 129, and 152 based on one or more of fuel vapor levels in the canister 122, pressure in the fuel tank 120, fuel level in the fuel tank 120, fuel vapor level in the fuel tank 120, vacuum level in the intake manifold 144, ambient temperature, engine temperature, time since most recent key-off event, etc. In examples where valves 161, 129 and 152 are solenoid valves, operation of the valves may be regulated by adjusting a driving signal (or pulse width) of the dedicated solenoid.

The fuel system 118 may further include a fuel vapor recirculation tube or line 131, which may be coupled on a first end to the fuel tank 120, and on an opposite second end to a fuel fill inlet (also referred to herein as fuel fill system) 119. The fuel vapor recirculation line 131 and/or the fuel vapor storage line 178 may be configured to hold a percentage of total fuel vapor generated during a refueling event. Thus, fuel vapors 107 from fuel tank 120 may be directed through the recirculation line 131 en route to the fuel fill inlet 119. Fuel fill inlet 119 may be configured to receive fuel from a fuel source such as dispensing nozzle 70. During a refueling event, the nozzle 70 may be inserted into the fill inlet 119, and fuel may be dispensed into the fuel tank 120. In some examples, fuel fill inlet 119 may include a fuel cap 105 for sealing off the fuel fill inlet 119 from the atmosphere. However, in other examples, the fuel fill inlet 119 may be a capless design and may not include a fuel cap 105. Fuel filler inlet 119 is coupled to fuel tank 120 via fuel filler pipe or neck 111. As such, fuel dispensed from the nozzle 70, may flow through the filler neck 111 into the tank 120.

Fuel fill inlet 119 may further include refueling lock 145. In some embodiments, refueling lock 145 may be a fuel cap locking mechanism. The refueling lock 145 may be configured to automatically lock the fuel cap 105 in a closed position so that the fuel cap 105 cannot be opened. The refueling lock 145 may be a latch or clutch, which, when engaged, prevents the removal of the fuel cap 105. The latch or clutch may be electrically locked, for example, by a solenoid, or may be mechanically locked, for example, by a pressure diaphragm.

Fuel vapors 107 from recirculation line 31, may flow into filler neck 111, and back into fuel tank 120. Thus a portion of fuel vapors 107 in the fuel tank 120, may flow out of the fuel tank through the GVV 83, into recirculation line 31, through filler neck 11, and back into the fuel tank 120.

Controller 112 may comprise a portion of a control system 114. Control system 114 is shown receiving information from a plurality of sensors 116 (various examples of which are described herein) and sending control signals to a plurality of actuators 181 (various examples of which are described herein). As one example, sensors 116 may include temperature sensor 140, oxygen sensor 126 located upstream of the emission control device 170, FTPT sensor 191, and hydrocarbon sensor 192. Other sensors such as pressure, temperature, air/fuel ratio, and composition sensors may be coupled to various locations in the engine system 100. As another example, the actuators may include fuel injector 166, throttle 162, FTIV 152, CVV 129, CPV 161, fuel pump 121, etc.

The control system 114 may include controller 112. The controller 112 may be shifted between sleep and wake-up modes for additional energy efficiency. During a sleep mode the controller may save energy by shutting down on-board sensors, actuators, auxiliary components, diagnostics, etc. Essential functions, such as clocks and controller and battery maintenance operations may be maintained on during the sleep mode, but may be operated in a reduced power mode. During the sleep mode, the controller will expend less current/voltage/power than during a wake-up mode. During the wake-up mode, the controller may be operated at full power, and components operated by the controller may be operated as dictated by operating conditions. The controller 112 may receive input data from the various sensors, process the input data, and trigger the actuators in response to the processed input data based on instruction or code programmed therein corresponding to one or more routines. Example control routines are described herein and with regard to FIGS. 3-4.

FIG. 2B illustrates one cylinder or combustion chamber of the engine system 100 described above with reference to FIG. 2A. Thus, FIG. 2B depicts the engine system 100 for a vehicle. Further, FIG. 2B, shows an example of engine system 100 including a turbocharger for compressing intake air provided to the engine cylinders 130. The vehicle may be an on-road vehicle having drive wheels which contact a road surface. Although FIG. 2B shows only one cylinder of the engine 110, it should be appreciated that as shown above with reference to FIG. 2A, the engine system 100 may comprise more than one cylinder. Components of engine system 100 already introduced and described in FIG. 2A, may not be reintroduced or described again in the description of FIG. 2B herein.

Engine 110 includes one of the cylinders 130, which includes cylinder walls 232 with piston 236 positioned therein and connected to crankshaft 240. The position of crankshaft 240 may be estimated based on outputs from a Hall effect sensor 218 coupled to the crankshaft 240. Thus, the speed at which crankshaft 240 rotates may be estimated based on outputs from the Hall effect sensor 218, which may be used to infer engine speed in revolutions per minute (rpm). Each of the cylinders 130 may communicate with intake manifold 144 and exhaust manifold 148 via respective intake valves 252 and exhaust valves 254. Each intake and exhaust valve may be operated by an intake cam 251 and an exhaust cam 253, respectively. Alternatively, one or more of the intake and exhaust valves may be operated by an electromechanically controlled valve coil and armature assembly. The position of intake cam 251 may be determined by intake cam sensor 255. The position of exhaust cam 253 may be determined by exhaust cam sensor 257.

Fuel injector 166 is shown positioned to inject fuel directly into one of the cylinders 130, which is known to those skilled in the art as direct injection. Alternatively, fuel may be injected to an intake port, which is known to those skilled in the art as port injection. Fuel injector 166 delivers liquid fuel in proportion to the pulse width of signal FPW from controller 112. Fuel is delivered to fuel injector 166 by the fuel system 118 (shown above in FIG. 2A) including fuel tank 120 (shown above in FIG. 2A), fuel pump 121 (shown above in FIG. 2A), and fuel rail. Fuel injector 166 is supplied operating current from driver 268 which responds to controller 112.

In addition, intake manifold 144 is shown communicating with electronic throttle 162 which adjusts a position of throttle plate 264 to control airflow to engine cylinders 130. This may include controlling airflow of boosted air from intake boost chamber 246. Electronic throttle 162 may be an electric motor, which is mechanically coupled to the throttle plate 264. As such, electrical input to the throttle 162, may be converted into mechanical rotational motion, which may be used to rotate the position of the throttle plate 264. The throttle 162 may adjust the position of the throttle plate 264 based on signals received from the controller 112. Thus, based on a desired engine torque, and engine operating conditions, the controller 112 may determine a desired throttle plate 264 position, and send signals to the throttle 162, for adjusting the position of the throttle plate 264 to the desired position.

Ambient air is drawn into cylinders 130 via intake passage 142, which may include air filter 256. Thus, air first enters the intake passage 142 through air filter 256. When included, compressor 262 then draws air from air intake passage 142 to supply boost chamber 246 with compressed air. In one example, compressor 262 may be a turbocharger, where power to the compressor 262 is drawn from the flow of exhaust gasses through turbine 264. Specifically, exhaust gases may spin turbine 264 which may be coupled to compressor 262 via shaft 261.

However, in alternate embodiments, the compressor 262 may be a supercharger, where power to the compressor 262 is drawn from crankshaft 240. Thus, the compressor 262 may be coupled to the crankshaft 240 via a mechanical linkage, which may be any suitable linkage for mechanically coupling the crankshaft 240 to the compressor 262, such as a belt. As such, a portion of the rotational energy output by the crankshaft 240, may be transferred via the mechanical linkage to the compressor 262 for powering the compressor 262. In still further examples, the engine 110 may not include the compressor 262, and as such the engine 110 may not be a boosted engine.

Distributorless ignition system 290 provides an ignition spark to cylinder 130 via spark plug 292 in response to controller 112. The ignition system 290 may include an induction coil ignition system, in which an ignition coil transformer is connected to each spark plug of the engine. Oxygen sensor 126 is shown coupled to exhaust manifold 148 upstream of exhaust catalyst 170. While the depicted example shows oxygen sensor 126 upstream of turbine 264, it will be appreciated that in alternate embodiments, oxygen sensor 126 may be positioned in the exhaust manifold downstream of turbine 264 and upstream of catalyst 170.

Catalyst 170 can include multiple catalyst bricks, in one example. In another example, multiple emission control devices, each with multiple bricks, can be used. Thus, catalyst 170 may be configured to reduce nitrogen oxides (NOx), and oxidize carbon monoxide (CO) and unburnt hydrocarbons (HCs) to water and carbon dioxide. Further, a temperature, Tcat1, of the catalyst 170 may be estimated based on outputs from a temperature sensor 224 coupled to the catalyst 170. Thus, the temperature sensor 224 may be physically coupled to the catalyst 170 and may be configured to measure/estimate a temperature of the catalyst. During DFSO, a temperature of the catalyst may decrease as the temperature of exhaust gasses may be reduced. However, in an alternate embodiment, temperature Tcat1 may be inferred from engine operation.

The air/fuel ratio entering the engine 110 may be regulated by controller 112 so that the air-fuel ratio is continuously cycled closely about the stoichiometric air-fuel ratio. In some examples, the stoichiometric air-fuel ratio may be an air-fuel ratio of approximately 14.7:1. In this way, the exhaust gas passing over the catalytic surfaces of the catalyst 170 is alternatively rich in oxygen and deficient in oxygen so as to promote the nearly simultaneous oxidation and reduction reactions. When the engine 110 runs lean, where the air to fuel ratio is greater than stoichiometric, the oxygen concentration of exhaust gasses and therefore the voltage output by the oxygen sensor 126 may be lower than when the engine 110 runs rich, where the air to fuel ratio is less than stoichiometric. Thus, the air/fuel ratio may be monitored based on outputs from the oxygen sensor 126. Specifically, the controller 112 may adjust an amount of fuel injected into the cylinder 130 based on outputs from the oxygen sensor 126 to achieve the desired stoichiometric air/fuel ratio.

However, the accuracy of the oxygen sensor 126 may be significantly reduced when the temperature of the oxygen sensor 126 is below a threshold. In some examples, the oxygen sensor 126 may not generate outputs when below the threshold temperature. Thus, the controller 112 may not receive signals from the oxygen sensor 126 prior to the oxygen sensor 126 reaching the threshold temperature. Specifically, a sensing element of the oxygen sensor 126 used to measure oxygen concentrations, such as a zirconium electrolyte, may need to be heated to the threshold temperature before measurements of the oxygen concentration of exhaust gasses can be taken. Said another way, the accuracy of estimates of the air/fuel ratio based on the oxygen sensor may be significantly reduced prior to the oxygen sensor 126 reaching the threshold temperature. Thus, during an engine start, before the oxygen sensor 126 is adequately heated, the controller 112 may not adjust the amount of fuel injected to the engine cylinder 130 based on outputs from the oxygen sensor 126.

As such, during an engine start, before the oxygen sensor 126 has reached the threshold, the controller 112 may send signals to the fuel injector 116 to inject a desired starting amount of fuel to one or more of the engine cylinders 130. Then, once the oxygen sensor has reached the threshold temperature, the controller 112 may begin to adjust the fuel injection amount based on outputs from the oxygen sensor 126, to achieve a relatively stoichiometric air/fuel ratio. The threshold temperature may represent a pre-set temperature stored in non-transitory memory of the controller 112. In some examples, the desired starting amount of fuel may be a fixed amount of fuel. However, in other examples, the desired starting amount of fuel may be adjusted based on ambient conditions such as barometric pressure, ambient temperature, humidity, engine temperature, altitude, etc.

In some examples, as shown below with reference to FIGS. 3-4, the amount of fuel injected to the one or more engine cylinder 130 may be adjusted based on an estimated fuel vapor flow rate to the intake manifold 144. As described above, during an engine start, the controller 112 may open the CPV 161 and/or FTIV 152, and purge fuel vapors from one or more of the fuel tank 120 and canister 122 to the intake manifold 144. The fuel vapor flow rate may be a mass flow rate of hydrocarbons from one or more of the fuel tank 120 and canister 122 to the intake manifold 144. Therefore, the fuel injection amount may be adjusted based on a mass flow rate of hydrocarbons from the fuel tank 120 and canister 122. In some examples, where the fuel contains biofuels, the fuel vapor flow rate may additionally include a mass flow rate of biofuels such as ethanol. As such, the fuel vapor flow rate may be estimated based on an amount of fuel vapors in one or more of the fuel tank 120 and canister 122 and on a vacuum level in the intake manifold 144.

However, in some examples, CVV 129 may be opened in addition to opening the CPV 161 to increase fuel vapor desorption from the canister 122. In such examples where the CVV 129 is opened, the estimated fuel vapor flow rate may be affected by the ambient air drawn into the EVAP system 151 through the CVV 129. Specifically, the concentration of hydrocarbons in the gasses flowing to the intake manifold 144 may be diluted by the ambient air drawn in though the CVV 129. Thus, the estimated fuel vapor flow rate may be adjusted based on a position of the CVV 129 to compensate for the dilution effects of the added ambient airflow. Thus, the amount of fuel injected to the intake manifold 144 may be reduced from the pre-set amount in response to increases in the estimated fuel vapor flow rate to the intake manifold 144.

During an engine start, the controller 112 may send signals to the fuel injector 166 for injecting the pre-set amount of fuel to one or more of the cylinder 130. In response to opening of the CPV 161, the controller 112, may then reduce the amount of fuel injected to the one or more engine cylinder 130, where the amount of reduction may be based on the estimated fuel vapor flow rate to the intake manifold 144. Specifically, the reduction in the fuel injection amount may be inversely proportional to the fuel vapor flow rate, so that an amount of fuel provided to the engine 110 is maintained during an engine start at approximately the desired starting amount. In this way, fuel vapors from the fuel tank 120 and/or canister 122 may be provided in addition to and/or in place of fuel injected from the injector 166 to achieve a desired starting amount of fuel during an engine start. Hydrocarbon emissions levels may be reduced by using fuel vapors from the fuel tank 120 and/or canister 122 to satisfy at least a portion or all of the fueling demands of the engine 110 during an engine start.

Controller 112 is shown in FIG. 1 as a microcomputer including: microprocessor unit 202, input/output ports 204, read-only memory 206, random access memory 208, keep alive memory 210, and a conventional data bus. Controller 112 is shown receiving various signals from sensors coupled to engine 110, in addition to those signals previously discussed, including: engine coolant temperature (ECT) from temperature sensor 212 coupled to cooling sleeve 214; a knock sensor for determining ignition of end gases (not shown); a measurement of engine manifold pressure (MAP) from pressure sensor 221 coupled to intake manifold 144; a measurement of boost pressure from pressure sensor 222 coupled to boost chamber 246; an engine position sensor from a Hall effect sensor 218 sensing crankshaft 240 position; and a measurement of air mass entering the engine from mass airflow sensor (MAF) sensor 220 (e.g., a hot wire air flow meter). Barometric pressure may also be sensed (sensor not shown) for processing by controller 112. In a preferred aspect of the present description, Hall effect sensor 218 produces a predetermined number of equally spaced pulses every revolution of the crankshaft from which engine speed (RPM) can be determined.

The controller 112 may determine a desired position of the throttle plate 264 based on one or more of inputs received from the input device 130 and pedal position (PP) signal, a vehicle weight, road incline, transmission gear, etc. In this particular example, the position of the throttle plate 264 may be varied by the controller 112 via a signal provided to an electric motor or actuator included with the throttle 162, a configuration that is commonly referred to as electronic throttle control (ETC). In this manner, the throttle 162 may be operated to vary the intake air provided to the cylinder 130 among other engine cylinders.

In some embodiments, the engine may be coupled to an electric motor/battery system in a hybrid vehicle. The hybrid vehicle may have a parallel configuration, series configuration, or variation or combinations thereof as described above with reference to FIG. 1.

In this way, an engine system may comprise a fuel tank for storing liquid fuel, fuel injectors for injecting the liquid fuel to one or more engine cylinders, a fuel pump included in the fuel tank and configured to pump liquid fuel from the fuel tank to the fuel injectors, and a controller with computer readable instructions for: sealing the fuel tank and operating the fuel pump to generate fuel vapors in the fuel tank prior to a cold start of the engine system, and routing fuel vapors in the fuel tank to the one or more engine cylinders during the cold start. The engine system may further comprise a fuel vapor storage canister positioned between the fuel tank and the engine cylinders.

Figure 4:
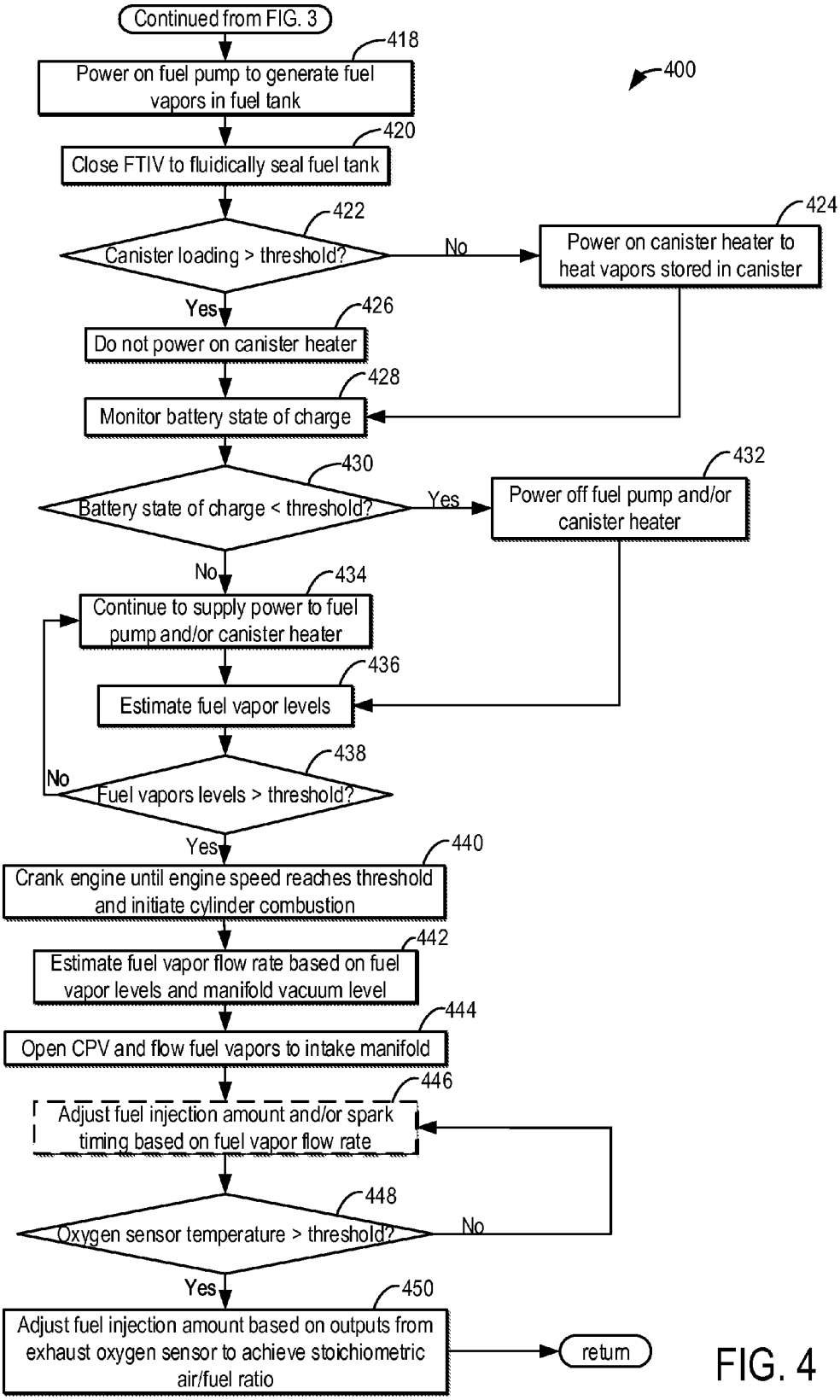
FIG. 4 shows a flow chart of an example method for regulating fuel vapor flow from an Evaporative Emissions Control (EVAP) system, to one or more engine cylinders during an engine cold start.

Turning now to FIGS. 3 and 4, they show flow charts of example methods, 300 and 400 respectively, for regulating fuel vapor flow from an evaporative emission control (EVAP) system (e.g., EVAP system 151 shown in FIG. 2A) to an intake manifold (e.g., intake manifold 144 shown in FIGS. 2A-2B) during an engine start. The flow chart in FIG. 3 shows an example method for determining if an engine cold start is imminent. If an engine cold start is imminent, then prior to the cold start, a fuel pump (e.g., fuel pump 121 shown in FIG. 2A) of a fuel tank (e.g., fuel tank 120 shown in FIG. 2A) may be powered on to generate fuel vapors in the fuel tank. During the engine cold start, fuel vapors stored in the fuel tank and/or a fuel vapor storage canister (e.g., canister 122 shown in FIG. 2A) may then be routed to the intake manifold to increase combustion efficiency in one or more engine cylinders (e.g., cylinders 130 shown in FIGS. 2A-2B). By increasing the combustion efficiency of an engine (e.g., engine 110 shown in FIGS. 2A-2B) during a cold start, emissions from the engine may be reduced.

Instructions for carrying out methods 300 and 400 may be stored in non-transitory memory of a controller (e.g., controller 112 shown in FIGS. 2A-2B). As such, methods 300 and 400 may be executed by the controller based on the stored instructions and in conjunction with signals received from sensors of an engine system (e.g., engine system 100 shown in FIGS. 2A-2B), such as the sensors described above with reference to FIGS. 2A-2B. The controller may employ engine actuators of the engine system to adjust engine operation, according to the methods described below. In particular, the controller may adjust operation of the fuel pump and/or the position of various valves of an Evaporative Emission Control (EVAP) system (e.g., EVAP system 151 shown in FIG. 2A) in response to a determination that an engine cold start is imminent.

Focusing now on FIG. 3, method 300 begins at 302 which comprises estimating and/or measuring engine operating conditions. Engine operating conditions may include a fuel tank pressure as estimated based on outputs from a fuel tank pressure sensor (e.g., FTPT sensor 191 shown in FIG. 1), a fuel level as estimated based on outputs from a fuel level sensor (e.g., fuel level sensor 138 shown in FIG. 1), an engine speed as estimated from a crankshaft position sensor (e.g., Hall effect sensor 218 shown in FIG. 2B), a driver demanded torque as estimated based on input from a vehicle operator (e.g., vehicle operator 132 shown in FIGS. 2A-2B) via an input device (e.g., input device 136 shown in FIGS. 2A-2B), etc.

After estimating engine operating conditions at 302, method 300 may then proceed to 304, which comprises determining whether or not the engine is off. Determining if the engine is off may be based on one or more of the engine speed, a position of a throttle valve (e.g., throttle 162 shown in FIGS. 2A-2B), fuel injection amount, manifold air pressure, a vehicle key-off event, the driver demanded torque, etc. Specifically, it may be determined that the engine is off if the engine speed is approximately zero. Thus, based on outputs from the crankshaft position sensor, the controller may estimate the engine speed. If the engine speed is approximately zero, then it may be determined that the engine is off. If it is determined at 304 that the engine is not off, and/or that the engine is running, then method 300 may proceed to 306 which comprises injecting fuel to the engine cylinders based on a position of the throttle, and a desired air/fuel ratio.

As explained above with reference to FIGS. 2A-2B, the desired air/fuel ratio may be approximately 14.7:1. However, in other examples, the desired air/fuel ratio may be greater or less than 14.7:1. Thus, an amount of fuel to be injected to the engine cylinders may be calculated to achieve the desired air/fuel ratio based on a measured and/or estimated mass airflow entering the engine. The mass airflow entering the engine may be measured based on outputs from a mass airflow sensor (e.g., MAF sensor 220 shown in FIG. 2B) positioned in an intake passage (e.g., intake passage 142 shown in FIGS. 2A-2B) of the engine. Additionally or alternatively, the mass airflow entering the engine may be inferred based on engine speed as measured from crankshaft position sensor and manifold pressure of the intake manifold as measured from a pressure sensor positioned in the intake (e.g., sensor 221 shown in FIG. 2B). Method 300 may then return.

However, if at 304 it is determined that fuel is not being injected to the engine, and that the engine is off, then method 300 may continue to 308 which comprises determining if an engine start is imminent and/or is desired. Engine starts may be predicted based on inputs received from the vehicle operator. As one example, an engine start may be predicted based on commands received from the vehicle operator via a wireless authentication device (e.g., wireless key fob). In another example, the engine start may be predicated based on a position of a wired authentication device (e.g., key). Thus, if a vehicle operator unlocks a vehicle system (e.g., vehicle system 6 shown in FIG. 1) with one or more of the wireless authentication device or wired authentication device then it may be determined at 308 that an engine start is imminent.

Additionally or alternatively, it may be determined that an engine start is imminent based on commands received from the vehicle operator via a wireless device such as a phone, tablet, computer, etc. The wireless device may include a software program with computer readable instructions for adjusting vehicle operating conditions (e.g., vehicle temperature, sound level, light level, etc.). Specifically, the wireless device may be in communication with the controller via a network (e.g., the Internet) for sending signals to the controller to adjust the operation of various vehicle components (e.g., heater, air conditioner, stereo, lights, etc.) to achieve vehicle operator desired conditions. In this way, a vehicle operator may, via their wireless device, set desired vehicle conditions, such as vehicle temperature, prior to entering the vehicle system. In some examples, the vehicle operator may set a desired engine start time. Thus, if commands are received from the wireless device to adjust vehicle conditions in anticipation of a vehicle operator entering the vehicle system, then it may be determined at 308 that an engine start is imminent.

In yet further examples, an engine start may be predicted based on input received from a vehicle operator via a communication system (e.g., message center 96) included in the vehicle system. The communication system may present various options, or modes to the vehicle operator. Thus, a vehicle operator may send signals to the controller via a touch display and/or button pad of the communication system, for adjusting operation of one or more vehicle components. As an example, the controller may receive input from the vehicle operator via the communication system to enter a cold start mode. In response to a selection of a cold start mode, the controller may send signals to the fuel pump to turn on, thereby generating vapors in the fuel tank. Thus, a vehicle operator may view a plurality of start modes for the vehicle system presented on a display of the communication system. The vehicle operator may then select one of the start modes depending on ambient conditions. For example, if cold start conditions are present (e.g., ambient temperature is below a threshold), then the vehicle operator may select the cold start mode.

In still further examples, an engine start may be determined to be desired based on a position of a key. For example, it may be determined that an engine start is desired in response to insertion of a key into an ignition. Said another way, an engine start may be desired in response to a key-on event.

If it is determined at 308 that an engine start is not imminent and/or is not desired, then method 300 may continue to 310 which comprises maintaining the engine off. However, if it is determined at 308 that an engine start is imminent, and/or is desired, then method 300 may proceed to 312 which comprises determining if cold start conditions are present.

Cold start conditions may be determined based on one or more of: time since a most recent key-off event, ambient temperature, engine system temperature, fuel temperature, and engine oil temperature, number of failed engine starts, engine coolant temperature, onboard vehicle connectivity such as wireless vehicle to vehicle communication and wireless vehicle to remote server communication. Thus, if more than a threshold amount of time has passed since the most recent key-off event where the engine was turned off, then it may be determined at 312 that a cold start condition exists. In another example, if one or more of the engine system temperature, engine oil temperature, or ambient temperature are below respective threshold temperatures, then it may be determined that a cold start condition exists. Ambient temperature may be estimated based on outputs from a temperature sensor of the vehicle system (e.g., temperature sensor 98 shown in FIG. 1) configured to measure ambient temperature. Additionally or alternatively, if more than a threshold number attempted engine starts are unsuccessful, then it may be determined that cold start conditions are present. An engine start may be unsuccessful if a starter motor (e.g., motor 20 shown in FIG. 1) cranks the engine, but cylinder combustion is not initiated and/or the engine does not generate enough power to maintain crankshaft rotation without power from the starter motor.

If it is determined at 312 that cold start conditions do not exist, then method 300 may continue to 314 which comprises determining if a key-on event has occurred. A key-on event may comprise a vehicle operator request to start the engine. In some examples, the key-on event may be triggered by a key in an ignition in keyed vehicle systems. However, in other examples, where the vehicle system may be keyless, the key-on event may be initiated by a button, touch display, or other user interface device.

If it is determined at 314 that a key-on event has not occurred, then method 300 may return to 312 and determine if cold start conditions exist. However, if it is determined at 314 that key-on event has occurred, then method 300 may continue from 314 to 316, which comprises cranking the engine with the starter motor and injecting a desired starting amount of fuel to the engine cylinders to initiate cylinder combustion. The desired starting amount of fuel may result in a leaner than stoichiometric air/fuel ratio during the engine start. Burning a lean air/fuel ratio during the engine start generates additional oxygen which may create an exotherm in the exhaust catalyst thereby heating the exhaust catalyst (e.g., catalyst 170 shown in FIGS. 2A-2B) at a faster rate. Heating the catalyst more quickly may reduce hydrocarbon emissions.

The desired starting amount may be a pre-set amount of fuel to be injected to the engine cylinders during an engine start. However, in other examples, the desired starting amount may be adjusted based on ambient conditions such as temperature, humidity, etc. For example, the desired starting amount of fuel may decrease with increasing ambient temperatures or engine temperatures. Additionally, the method at 314 may comprise determining a desired starting spark timing. The desired starting spark timing may be a preset spark timing that may be retarded from a set point, where the set point may be approximately maximum brake torque (MBT). This retarded ignition timing will cause an increase in exhaust temperatures thereby heating the exhaust catalyst. Further, the desired starting spark timing may in some examples be adjusted based on ambient temperature or engine temperatures, where an amount of spark retard may increase with decreasing engine temperatures and/or ambient temperatures.

In some examples, the method at 316 may additionally comprise opening a canister purge valve (e.g., CPV 161 shown in FIG. 2A) and/or a fuel tank isolation valve (e.g., FTIV 191 shown in FIG. 2A) to route fuel vapors from one or more of the canister and/or fuel tank to the intake manifold for combustion in the engine cylinders. Further, the amount of fuel injected to the engine cylinders may be reduced from the desired starting amount based on an estimated fuel vapor flow rate to the intake manifold from the EVAP system. As described above with reference to FIG. 2A, the fuel vapor flow rate to the intake manifold may be estimated based on an amount of fuel vapors stored in the fuel tank and fuel canister, and a vacuum level in the intake manifold. Intake manifold vacuum level may be estimated based on outputs from a pressure sensor (e.g., pressure sensor 221 shown in FIG. 2B) positioned in the intake manifold. Fuel vapor levels in the canister may be estimated based on outputs from a temperature sensor coupled to the canister (e.g., temperature sensor 140 shown in FIG. 2A). An amount of fuel vapors in the fuel tank may be estimated based on outputs from one or more of a fuel tank pressure sensor (e.g., FTPT 191 shown in FIG. 2A), a hydrocarbon sensor (e.g., hydrocarbon sensor 192 shown in FIG. 2A), and a fuel level sensor (e.g., fuel level sensor 138 shown in FIG. 2A). The fuel vapor flow rate to the intake manifold may increase for increases in the amount of fuel vapors in the fuel tank and canister, and for increases in the vacuum level of the intake manifold.

Further, in some examples, the method at 316 may additionally include opening a canister vent valve (e.g., CVV 129 shown in FIG. 2A), to flow ambient air through the canister to the intake manifold, and increase hydrocarbon desorption from the canister. However, opening the canister vent valve (CVV), may affect the mass flow rate of hydrocarbons to the intake manifold. Specifically, the ambient air drawn into the intake manifold through the canister vent valve may dilute the concentration of hydrocarbons in the gasses flowing to the intake manifold. Thus, estimations of the fuel vapor flow rate may be adjusted based on a position of the canister vent valve. In some examples, the fuel vapor flow rate may decrease with increasing deflection of the CVV away from a closed position towards an open position. As such, the fuel vapor flow rate may decrease for increases in ambient airflow through the CVV.

Fuel injection to the one or more engine cylinders may be reduced from the desired starting amount by an amount proportional to the fuel vapor flow rate. Thus, fuel injection amount may be reduced to a greater extent for increases in the fuel vapor flow rate. In this way, the fuel injection amount may be adjusted based on the fuel vapor flow rate, to achieve the desired starting amount of fuel in the one or more engine cylinders.

In this way, if it is determined that cold start conditions do not exist, but that an engine start is imminent, the method 300 may comprise waiting until a key-on event, and initiating cylinder combustion by cranking the engine with a starter motor, and injecting a desired starting amount of fuel to one or more engine cylinders. Method 300 may then return.

However, if it is determined that cold start conditions do exist, and that an engine start is imminent, then method 300 may continue from 312 in FIGS. 3 to 418 in FIG. 4, which comprises powering on the fuel pump to generate vapors in the fuel tank.

Turning now to FIG. 4, it shows example method 400 which may be executed in response to a determination that an engine start is imminent during cold start conditions. Said another way, method 400 may be executed during an engine cold start to generate fuel vapors in the fuel tank prior to the engine start. During a cold start, fuel vapors generated in the fuel tank may be routed to the intake manifold for combustion. Method 400 may continue from 312 in FIG. 3, if it is determined at 312 that cold start conditions are present prior to an engine start.

If cold start conditions are present prior to an engine start, then method 400 begins at 418 by powering on the fuel pump to generate fuel vapors in the fuel tank. Specifically, the controller may send signals to one or more of a vehicle battery (e.g., energy storage device 50 shown in FIG. 1) or a battery of the fuel pump to provide power to the fuel pump. As the fuel pump spins, it may generate vapors in the fuel tank.

Additionally or alternatively, method 400 may commence at 418 in response to a selection of the cold start mode from a vehicle operator via one or more of the communication system, mobile device, etc. Thus, a vehicle operator may select a cold start mode via a software application on their mobile device before or after entering the vehicle system. In other examples, the vehicle operator may select the cold start mode via buttons or touch display included in the communication system. In response to the vehicle operator selection of the cold start mode, the controller may initiate method 400 and may power on the fuel pump to generate vapors in the fuel tank prior to the engine start.

Method 400 may then continue to 420 which comprises closing the FTIV to fluidically seal the fuel tank. Specifically, the controller may send signals to an actuator of the FTIV, to adjust the position of the FTIV to a closed position, so that the fuel tank is fluidically sealed from the engine and canister. Further, in some examples, the method at 420 may additionally comprise closing the CPV and a CVV (e.g., CVV 129 shown in FIG. 2A) so that the canister is fluidically sealed from the engine and atmosphere. Sealing the fuel tank from the EVAP system and engine may increase an amount of fuel vapors generated in the fuel tank prior to the engine start. It is important to note that in some examples, the FTIV, CPV and CVV may be closed prior to powering on the fuel pump. In still further examples, the controller may execute 418 and 420 approximately simultaneously, and as such the FTIV, CPV and CVV may be closed approximately at the same time as when the fuel pump is powered on.

In some examples, method 400 may then continue from 420 to 422 which comprises determining if canister loading is greater than a threshold. Canister loading may represent an amount of fuel vapors in the canister which may be estimated based on outputs from a temperature sensor (e.g., temperature sensor 140 shown in FIG. 2A) coupled to the canister. However, in other examples, the canister loading may be estimated based on a most recent estimate of the canister load during a most recent key-off event. If the canister loading is not greater than the threshold, then method 400 may continue from 422 to 424 which comprises powering on a canister heater (e.g., heater 160 shown in FIG. 2A) to heat vapors stored in the canister and increase fuel vapor desorption in the canister. Specifically, the controller may send signals to a power source of the canister heater such as the vehicle battery to provide electrical power to the heater.

Alternatively, if it is determined at 422 that the canister loading is greater than the threshold, then method 400 may continue to 426 which comprises not powering on the canister heater. Thus, the heater may only be powered on to increase fuel vapor desorption in the canister if the canister loading is less than the threshold at 422.

Method 400 may then continue from either 424 or 426 to 428 which comprises monitoring the battery state of charge. The battery stage of charge may be monitored based on outputs from a state of charge indicator (e.g., state of charge indicator 51 shown in FIG. 1). Method 400 may then continue from 428 to 430 which comprises determining if the battery state of charge is less than a threshold. The threshold may represent a state of charge level of the battery, below which may result in engine start failures. If the battery state of charge is less than the threshold, then method 400 may proceed from 430 to 432 which comprises powering off one or more of the fuel pump and/or canister heater to preserve the battery state of charge. Thus, one or more of the fuel pump and/or canister heater may be turned off prior to the engine start, if the battery state of charge drops below the threshold, so as to prevent the battery from draining past a point where the battery would not contain sufficient electrical power to crank the engine.

However, if the battery state of charge is not less than the threshold, then method 400 may continue from 430 to 434 and power may continue to be supplied to one or more of the fuel pump and canister heater.

Method 400 may then continue from 434 or 432 to 436 which comprises estimating fuel vapor levels. In one example, the method 400 at 436 may comprise estimating fuel vapor levels in the fuel tank. Fuel vapor levels in the fuel tank may be estimated based a pressure in the fuel tank as estimated based on outputs from the fuel tank pressure (FTPT) sensor and an amount of fuel in the fuel tank as estimated from a fuel level sensor (e.g., fuel level sensor 138 shown in FIG. 2A). The pressure in the fuel tank may increase for increases in both the fuel level and the amount of fuel vapors in the fuel tank. Alternatively, the amount of fuel vapors in the fuel tank may be estimated based on outputs from a hydrocarbon sensor (e.g., hydrocarbon sensor 192 shown in FIG. 2A).

After estimating fuel vapor levels in the fuel tank at 436, method 400 may continue to 438 which comprises determining if the fuel vapor levels are greater than a threshold. The threshold at 438 may represent an amount of fuel vapors in the fuel tank below which may not be sufficient to initiate cylinder combustion in the engine. If the fuel vapor levels in the fuel tank are below the threshold, method 400 may return to 434 and continue to supply power to the fuel pump to generate more fuel vapors in the fuel tank, until the fuel vapor levels in the fuel tank reach the threshold. In response to the fuel vapor levels in the fuel tank reaching the threshold at 438, method 400 may continue to 440 and the controller may send signals to the starter motor to crank the engine. Thus, the controller may initiate cranking of the engine in response to fuel vapor levels in the fuel tank reaching the threshold.

In other examples, the vehicle operator may be instructed via the communication system to turn on the engine once the fuel vapor levels in the fuel tank have reached the threshold. Specifically, a light or indicator may be presented to the user on a display of the communication system when the fuel vapor levels in the fuel tank have reached the threshold. Thus, in some examples, a vehicle operator may be instructed to wait to start the engine until fuel vapors in the fuel tank have reached the threshold at 438. Then, once fuel vapors in the fuel tank have reached the threshold, the vehicle operator may be instructed to start the engine by one or more of turning an ignition switch with a key, or pushing a button or other input device configured to signal the battery to provide power to the starter motor for cranking the engine.

However in other examples, if it desired by the vehicle operator to start the engine before the fuel vapor levels in the fuel tank have reached the threshold at 438, then the method 400 may proceed from 438 to 440 and crank the engine even if the fuel vapor levels in the fuel tank are less than the threshold.

Thus, in response to the fuel vapor levels reaching the threshold, or input from a vehicle operator to start the engine, method 400 may continue from 438 to 440 and the starter motor may crank the engine. The starter motor may continue to crank the engine until the engine speed reaches a threshold. Engine speed may be estimated based on outputs from a crankshaft position sensor (e.g., Hall effect sensor 218 shown in FIG. 2B). The threshold engine speed may be an engine speed, at which the intake manifold vacuum level is sufficient to draw in fuel vapors from the fuel tank and/or fuel vapor canister. In some examples, the threshold engine speed may be approximately 200 rpm. However in other examples, the threshold engine speed may be greater or less than 200 rpm. In some examples, the method at 400 may additionally comprise injecting a desired starting amount of fuel into one or more of the engine cylinders to initiate cylinder combustion during the engine cranking Thus, fuel may be injected to the one or more engine cylinders while the engine is cranked by the starter motor, to initiate cylinder combustion. Cylinder combustion may be initiated by igniting an air fuel mixture in one or more of the engine cylinders with a spark provided from a spark plug (e.g., spark plug 292 shown in FIG. 2B). Specifically, the controller may send a signal to the spark plug for igniting the air/fuel mixture.

In still further examples, the method at 400 may alternatively comprise cranking the engine until the intake manifold vacuum level reaches a threshold. Said another way, the method at 400 may comprise cranking the engine until the intake manifold pressure decreases below a threshold. The intake manifold vacuum level may be estimated based on outputs from a pressure sensor coupled to the intake manifold (e.g., sensor 221 shown in FIG. 2B). The threshold vacuum level may be a vacuum level sufficient to draw fuel vapors from the fuel tank and/or canister to the intake manifold.

After cranking the engine with the starter motor, the method 400 may then proceed to 442 which comprises estimating a fuel vapor flow rate based on fuel vapor levels in the fuel tank and intake manifold vacuum levels. Thus, the method 400 may comprise estimating a fuel vapor flow rate to the intake manifold that would result from opening of the CPV. As such, the fuel vapor flow rate may be estimated based on an amount of vacuum in the intake manifold which may be estimated based on outputs from the pressure sensor positioned in the intake manifold. Further, the fuel vapor flow rate may be estimated based on amount of fuel vapors in the fuel tank as determined at 436, and an amount of fuel vapors in the canister as determined at 422. More specifically, the method at 400 may comprise estimating a fuel vapor flow rate that would result from opening only the CPV.

However, in another example, the method 400 at 442 may comprise estimating a fuel vapor flow rate that would result from opening the CPV and the FTIV. As described above with reference to FIG. 2A, the fuel vapor flow rate may be a mass flow rate of hydrocarbons. Thus, fuel vapor flow rates may increase with increasing intake manifold vacuum levels, and/or increasing fuel vapor levels in the fuel tank and canister. Further, the fuel vapor flow rates may increase with increasing deflection of one or more of the CPV and FTIV towards an open position away from a closed position. Thus, as the opening formed by the CPV increases, fuel vapor flow rates to the intake manifold may increase. Further, while the CPV is open, fuel vapor flow rates to the intake manifold may increase as an opening formed by the FTIV increase.

In still another example, the method 400 at 442 may comprise estimating a fuel vapor flow rate that would result from opening the CPV, FTIV, and CVV. Opening the CVV may draw in fresh ambient air through the canister en route to the intake manifold, which may dilute the hydrocarbon content of the gasses flowing to the intake manifold. Thus, in some examples, the fuel vapor flow rate to the intake manifold may decrease as an opening formed by the CVV increases. However, in some examples, opening of the CVV may increase fuel vapor flow rates by increasing fuel vapor desorption in the canister. Specifically, since hydrocarbon desorption from the canister may be reduced at lower temperatures opening the CVV may have a greater effect on fuel vapor desportion from the canister at lower canister temperatures. Thus, the fuel vapor flow rate to the intake manifold may additionally be estimated based on a temperature of the canister as estimated based on outputs from a temperature sensor (e.g., temperature sensor 140 shown in FIG. 2A) coupled to the canister.

It is important to note that in some examples, the controller may execute 440 and 442 simultaneously. Thus, the fuel vapor flow rate that would result from opening one or more of the CPV, FTIV, and CVV may be estimated while the engine is being cranked by the starter motor. As such, estimates of the fuel vapor flow rate may increase as the engine speed increases during engine cranking, since the intake manifold vacuum may increase as engine speed increases.

Once the engine speed reaches the threshold at 440, method 400 may then continue from either 400 or 442 to 444 and open the CPV. Thus, once the engine speed reaches the threshold at 440, the intake manifold vacuum may be sufficient to draw in fuel vapors from the fuel tank and fuel vapor canister upon opening of the CPV. In some examples, the method at 444 may additionally comprise opening the FTIV and the CVV. Thus, the method 400 at 444 may comprise opening the CPV and one or more of the FTIV and CVV, and therefore flowing fuel vapors from the canister and/or fuel tank to the intake manifold of the engine. The method at 444 may therefore comprise sending signals to one or more of the respective actuators of the FTIV, CPV, and CVV to adjust the position of the valves to a more open position, so that an opening formed by the valves increases. In this way, an amount of fuel vapors flowing from the fuel tank, and or the canister to the intake manifold may be increased during cranking of the engine. The starter motor provides an initial crank to the engine, to begin piston movement within the engine cylinders. The reciprocating motion of pistons (e.g., piston 236 shown in FIG. 2B) of the engine cylinders may create sufficient vacuum to suck in the fuel vapors from the canister and/or fuel tank to the intake manifold for combustion in the engine cylinders. In this way, fuel vapors in the fuel tank and/or canister may be utilized during an engine start to increase combustion efficiency.

It should be appreciated that in some examples, fuel may not be injected to the engine cylinders at 440 during engine cranking, and that cylinder combustion may not be initiated until the engine speed reaches the threshold and the CPV is opened at 444. Thus, in some examples, an amount of fuel required to initiate cylinder combustion may be provided from fuel vapors of the fuel tank and/or fuel canister only. Said another way, the threshold at 438 may represent a fuel vapor level which is sufficient to initiate cylinder combustion upon opening of the CPV when cranking the engine. If the fuel vapor level in the fuel tank exceeds the threshold at 438, during and/or before engine cranking at 440, then after opening the CPV at 444, the fuel vapor flow rate to the intake manifold may be high enough to provide an adequate amount of fuel vapors for initiating cylinder combustion. The amount of fuel vapors required to initiate cylinder combustion may be the desired starting amount of fuel described above with reference to FIG. 3. In this way liquid fuel may not be provided to the engine cylinder during the initiation of cylinder combustion, and cylinder combustion may be initiated by the fuel vapors alone.

However, in still further examples, a combination of fuel vapors and liquid fuel may be provided to initiate cylinder combustion. For example, if the amount of fuel vapors delivered to the intake manifold by the fuel tank and/or canister is not sufficient to initiate cylinder combustion, then liquid fuel may be provided during engine cranking. In some examples, if it is desired by the vehicle operator to start the engine before the fuel vapor levels reach the threshold at 438, then the fuel vapors from the fuel tank and/or canister alone may not be sufficient to start the engine. However, in still further examples, cylinder combustion may be initiated by liquid fuel alone, and fuel vapors may be provided to the engine cylinders after the initiation of cylinder combustion, once the engine speed has reached the threshold.

Once the CPV is open so that fuel vapors are flowing to the intake manifold, method 400 may continue from 444 to 446 which comprises adjusting the fuel injection amount and/or spark retard based on the fuel vapor flow rate. Thus, the controller may actively update estimates of the fuel vapor flow rate during an engine start and after cylinder combustion has been initiated. Based on the estimated fuel vapor flow rate, the controller may adjust an amount of fuel injected to one or more of the engine cylinder via fuel injectors (e.g., fuel injector 166 shown in FIGS. 2A-2B). Specifically, the controller may send an electrical signal to the fuel injectors to adjust an amount of fuel injected into the one or more engine cylinders based on the estimated fuel vapor flow rate.

Before the oxygen sensor has reached the threshold temperature, the desired starting amount of fuel may be provided to the engine cylinders. As described above the desired starting amount of fuel may be a pre-set amount of fuel stored in the memory of the controller. However, in some examples, the desired starting amount of fuel may be adjusted based on operating conditions at the engine start, such as fuel temperature, ambient temperature, ambient humidity, engine temperature, etc. Specifically, the desired starting amount of fuel may decrease for increases in one or more of the ambient temperature, engine starting temperature, or fuel temperature. In some examples, the desired starting amount of fuel may result in a leaner than stoichiometric (14.7:1) air to fuel ratio. In this way, exhaust gas temperature may be increased.

However, in other examples, the desired starting amount of fuel may result in a richer than stoichiometric air to fuel ratio. Since, fuel may ignited more easily at higher fuel temperatures, engine temperatures and ambient temperatures, the amount of fuel required to initiate cylinder combustion may decrease for increases in the fuel temperature, engine temperature, and ambient temperature.

The desired starting amount of fuel may be provided to the engine cylinders from the fuel tank vapors and canister vapors, and/or from liquid fuel injected from the fuel injectors. As described above, fuel may be sourced from the fuel tank and canister by opening one or more of the CPV, FTIV, and CVV. If the fuel vapors from the fuel tank and canister are not sufficient to achieve the desired starting amount of fuel, then liquid fuel may be injected via the injectors, so that the total fuel amount provided to the engine cylinders approximately matches the desired starting amount. Said another way, if the estimated fuel vapor flow rate provides less than the desired starting amount of fuel to the engine cylinders, then fuel may be injected to the engine cylinders to achieve the desired starting amount of fuel. In this way, an amount of fuel injected to the one or more engine cylinders may increase for increases in the difference between the desired starting amount of fuel, and the amount of fuel provided to the engine cylinders as estimated based on the fuel vapor flow rate.

Said another way, the amount of fuel injected to the engine cylinders may be adjusted based on the fuel vapor flow rate so that the total amount of fuel (both fuel vapors and liquid fuel) provided to the engine cylinders is approximately the desired starting amount. Thus, the amount of fuel injected to the engine cylinders may be inversely proportional to the fuel vapor flow rate, where the amount of liquid fuel injected decreases for increases in the fuel vapor flow rate. In examples where cylinder combustion is initiated at 440, prior to the engine speed reaching the threshold and the CPV opening, liquid fuel may be injected. Specifically liquid fuel in the amount of the desired starting amount of fuel may be injected to the engine cylinders. The amount of liquid fuel injected to the engine cylinders may then be reduced from the desired starting amount in response to the opening of the CPV, and the flowing of fuel vapors from the fuel tank and canister to the intake manifold. Specifically, the amount that the fuel injection is reduced from the desired starting amount may be proportional to the amount of increase in the fuel vapor flow rate. In this way, a combination of liquid fuel and fuel vapors may be used during an engine start to provide an approximately constant amount of fuel to the engine cylinders.

Further, the method at 446 may additionally comprise adjusting the spark timing of the spark plug. Specifically, the spark timing may be retarded from a set point, where the set point may be approximately MBT. In some examples, such as where no fuel is injected to the one or more engine cylinders, and where all of the fuel provided to the engine cylinders is sourced from the fuel vapors of the fuel tank and/or canister, the spark timing may not be retarded from the set point. Since the fuel vapors in the fuel tank and canister may be more volatile than the liquid fuel from the fuel tank, combustion efficiency and exhaust gas temperature may be higher for greater ratios of fuel vapors to liquid fuel delivered to the engine cylinders.

The desired spark timing may be more retarded for lower ratios of fuel vapors to liquid fuel. Said another way, the amount that the spark timing is retarded from the set point may increase for decreases in the fuel vapor flow rate, and/or for increases in the amount of liquid fuel injected to the one or more engine cylinders. In this way, exhaust gas temperatures may be kept sufficiently high to heat the oxygen sensor, and/or exhaust catalyst (e.g., catalyst 170 shown in FIGS. 2A-2B).

The desired starting amount of fuel may be an amount of fuel provided to the one or more engine cylinders during an engine start, before an exhaust oxygen sensor (e.g., oxygen sensor 126 shown in FIGS. 2A-2B) has been heated to a threshold temperature. Once the oxygen sensor has been heated to the threshold temperature, its outputs may be used to indicate an air/fuel ratio provided to the engine cylinders which may be used to adjust an amount of fuel provided thereto.

Method 400 may therefore proceed from 446 to 448 which comprises determining if the temperature of the exhaust oxygen sensor is greater than a threshold. The threshold exhaust oxygen sensor threshold may represent a temperature below which the accuracy of outputs from the oxygen sensor are significantly reduced, or in some examples, outputs are not generated by the sensor. Thus, the threshold may represent a temperature, below which, the oxygen sensor may not generate outputs, and/or outputs from the oxygen sensor may not be received by the controller. However, the oxygen sensor may generate outputs indicative of an air/fuel mixture provided to the engine cylinders when the oxygen sensor temperature is above the threshold. Specifically changes in oxygen concentration of exhaust gasses may be used to infer changes in the air to fuel ratio of gasses in the one or more engine cylinders.

If the oxygen sensor temperature is below the threshold at 448, then method 400 may return to 446 and continue to adjust the fuel injection amount based on the fuel vapor flow rate to achieve the desired starting amount of fuel. Once the oxygen sensor has reached the threshold temperature, the method may continue to 450 which comprises adjusting the fuel injection amount based on outputs from the exhaust oxygen sensor to achieve a stoichiometric air/fuel ratio. In other examples, the method 400 may comprise adjusting the CPV to achieve a stoichiometric air/fuel ratio. Thus, in response to air to fuel ratio increasing above stoichiometric, the controller may increase the fuel injection amount and/or increase an opening of the CPV. Similarly, in response to the air to fuel ratio decreasing below stoichiometric, the controller may reduce the fuel injection amount and/or decrease the opening of the CPV. Thus, the controller may adjust the air/fuel ratio by adjusting the fuel injection amount from the fuel injectors and/or by adjusting the position of the CPV and one or more of the FTIV and CVV.

In some examples, the method 400 at 450 may additionally or alternatively comprise closing the CPV in response to the estimated fuel vapor flow rate decreasing below a threshold. In some examples the threshold may be approximately zero. Thus, when fuel vapors have been purged from one or more of the fuel tank and canister, so that the fuel vapor levels in the fuel tank and/or canister are below respective threshold levels, the CPV may be closed.

However, in other examples, the CPV may be closed when the exhaust catalyst temperature increases above a threshold temperature. The exhaust catalyst temperature may be estimated based on outputs from a temperature sensor (e.g., temperature sensor 224 shown in FIG. 2B) coupled to the catalyst and configured to measure a temperature of the catalyst. Method 400 may then return.

It should be appreciated that although method 400 has been described to be employed only during cold start conditions, it may also be executed during other engine start conditions as well.

In this way, during an engine start, and prior to an exhaust oxygen sensor heating up to a threshold temperature, an amount of fuel injected to one or more engine cylinders may be adjusted based on an estimated fuel vapor flow rate to an intake manifold of the engine. Then, once the oxygen sensor has reached the threshold temperature, the amount of fuel injected to the one or more engine cylinders may be adjusted based on an air/fuel ratio as estimated based on outputs from the exhaust oxygen sensor.

The estimated fuel vapor flow rate may be determined based on an amount of fuel vapors in a fuel tank and a fuel vapor storage canister and an amount of vacuum in the intake manifold. If a canister vent valve is opened to bring in fresh air to desorb adsorbed fuel vapors in the canister and purge the canister, then estimations of the fuel vapor flow rate may be adjusted to compensate for the ambient airflow through the canister vent valve. Fuel vapor flow rates may increase for increases in the amount of fuel vapors in the fuel tank and/or canister, and for increases in the amount of vacuum in the intake manifold. For a given fuel level in the fuel tank, the amount of fuel vapors in the fuel tank may increase for increases in the pressure of the fuel tank. Similarly, for a given pressure in the fuel tank, the amount of fuel vapors in the fuel tank may increase for decreases in the fuel level in the fuel tank.

A portion or all of a desired starting amount of fuel, which may be sufficient to initiate cylinder combustion and maintain cylinder combustion prior to the oxygen sensor reaching the threshold temperature may be provided by fuel vapors from the fuel tank and/or canister. By providing fuel vapors to the intake manifold at and/or during an engine start, combustion efficiency of the engine may be increased, and therefore emissions may be reduced. Further, since the volatility of the fuel provided to the engine cylinders may be increased by providing the fuel vapors, engine start failures may be reduced.

In this way, a method may comprise, prior to a cold start of an engine: sealing a fuel tank from an evaporative emissions control system and an air intake of the engine operating a fuel pump of the fuel tank to generate vapors in the fuel tank, and in response to fuel vapor levels in the fuel tank reaching a threshold, initiating cylinder combustion and flowing fuel vapors from the fuel tank to an intake manifold of the engine. Sealing the fuel tank may comprise closing a fuel tank isolation valve positioned between the fuel tank and the intake manifold. Further, initiating cylinder combustion may comprise cranking the engine with a starter motor and injecting liquid fuel to the engine. In some examples, the fuel vapor levels may be estimated based a pressure in the fuel tank and a fuel level in the tank, where the pressure may be estimated based on outputs from a pressure sensor coupled to the fuel tank and the fuel level may be estimated based on outputs from a fuel level sensor positioned within the fuel tank. The method may additionally include prior to an exhaust oxygen sensor reaching a threshold temperature, delivering a desired starting amount of fuel to the engine, the desired starting amount of fuel including one or more of liquid fuel and fuel vapors, where an amount of liquid fuel injected to the engine may be inversely proportional to an amount of fuel vapors flowing to the intake manifold. In some examples, the amount of fuel vapors flowing to the intake manifold may be estimated based on the fuel vapor levels in the fuel tank and a vacuum level in the intake manifold may be estimated based on outputs from a pressure sensor coupled to the intake manifold. The method may additionally or alternatively include after an exhaust oxygen sensor reaches a threshold temperature, adjusting one or more of a fuel injection amount via fuel injectors and an amount of fuel vapors flowing to the intake manifold by adjusting a position or duty cycle of a canister purge valve, to achieve a stoichiometric air to fuel ratio, where the amount of fuel vapors flowing to the intake manifold may be estimated based on outputs from the exhaust oxygen sensor. Flowing fuel vapors from the fuel tank to the intake manifold may in some examples comprise opening a canister purge valve positioned in a purge line, the purge line providing fluidic communication between the fuel tank and the intake manifold. The fuel vapors from the fuel tank may be routed to the intake manifold during an engine start after one or more prior attempts to start the engine without the routing of the fuel vapors to the intake manifold. In any of the above examples, of the method the fuel vapors from the fuel tank may continue to be delivered to the intake manifold after initiating cylinder combustion.

In another representation, a method may comprise, prior to a cold start of an engine: sealing a fuel tank from an evaporative emissions control system and an air intake of the engine, and operating a fuel pump of the fuel tank to generate vapors in the fuel tank. The method may additionally comprise cranking the engine with a starter motor, and in response to engine speed reaching a threshold, opening a canister purge valve (CPV) and flowing fuel vapors from the fuel tank and a fuel vapor storage canister to an intake manifold of the engine. Additionally, the method may comprise during the cold start and prior to an exhaust oxygen sensor reaching a threshold temperature, providing a desired amount of fuel to the engine, the desired amount of fuel comprising one or more of liquid fuel injected from one or more fuel injectors and fuel vapors from the fuel tank and canister. The method may additionally comprise prior to the engine speed reaching the threshold, injecting liquid fuel in an amount equivalent to the desired amount of fuel to one or more engine cylinders while cranking the engine to initiate cylinder combustion. In any of the above examples, the method may additionally comprise reducing the amount of liquid fuel injected to the one or more engine cylinders from the desired amount in response to the opening of the canister purge valve, where the amount that the liquid fuel is reduced is proportional to an amount of fuel vapors flowing to the intake manifold, so that the desired amount of fuel continues to be provided to the engine prior to the exhaust oxygen sensor reaching the threshold temperature. In some examples, the any of the above mentioned embodiments of the method may additionally comprise not injecting liquid fuel to the engine prior to the engine speed reaching the threshold, and initiating cylinder combustion once the engine speed has reached the threshold by igniting the fuel vapors from the fuel tank and fuel vapor storage canister via a spark from a spark plug. Additionally or alternatively, the method may comprise turning off the fuel pump prior to the engine cold start in response to a state of charge of a vehicle battery decreasing below a threshold. The method of any one or combination of the above examples, may further comprise opening a fuel tank isolation valve and a canister vent valve in response to the engine speed reaching the threshold. In some examples, any of one or combination of the above examples of the method may further involve heating the fuel vapor storage canister with a heater coupled to the canister prior to opening of the CPV. The threshold engine speed may represent an engine speed at which a vacuum level in the intake manifold is sufficient to draw in fuel vapors from the fuel tank and canister.

Referring now to FIG. 5, it shows a graph 500, illustrating changes in a fuel vapor flow rate to an intake manifold (e.g., intake manifold 144 shown in FIGS. 2A-2B) of an engine (e.g., engine 110 shown in FIGS. 2A-2B) from an EVAP system (e.g., EVAP system 151 shown in FIG. 1) and/or a fuel system (e.g., fuel system 118 shown in FIG. 2A) under varying engine operating conditions. Graph 500 includes an indication of engine speed at plot 502, fuel injection amount at plot 504, air/fuel ratio at plot 506, and an exhaust oxygen sensor temperature at plot 508. Further, graph 500 provides depictions of changes in ambient temperature at plot 510, operation of a fuel pump (e.g., fuel pump 121 shown in FIG. 2A) at plot 512, fuel vapor levels in a fuel tank (e.g., fuel tank 120 shown in FIG. 2A) at plot 514, a fuel vapor flow rate to the intake manifold at plot 516, and a position of a CPV (e.g., CPV 161 shown in FIG. 2A) at plot 518.

The engine speed may be estimated based on outputs from a crankshaft position sensor (e.g., Hall effect sensor 218 shown in FIG. 2B). Further, the fuel injection amount may be an amount of fuel commanded to be injected to one or more engine cylinders (e.g., engine cylinders 130 shown in FIGS. 2A-2B) by a controller (e.g., controller 112 shown in FIGS. 2A-2B). The air/fuel ratio may be estimated based on outputs from an exhaust oxygen sensor (e.g., oxygen sensor 126 shown in FIGS. 2A-2B) as described above with reference to FIGS. 2A-2B. However, the oxygen sensor may need to be heated to a threshold temperature before the sensor generates output signals to the controller. Thus, periods of time where the oxygen sensor is heated past the threshold temperature and is generating output signals to the controller are shown by the solid lines of plot 506. The dashed lines of plot 506, show periods of time where the oxygen sensor temperature may be below the threshold, and thus the air/fuel ratio may not be estimated by the controller. However, in some examples, the controller may estimate the air/fuel ratio based on the fuel injection amount and a measurement or estimate of the mass of air entering the engine. Thus, $T_1$ may represent the threshold temperature of the oxygen sensor, below which the oxygen sensor does not generate output signals to the controller.

Changes in the ambient temperature as shown as plot 510 may be estimated based on outputs from a temperature sensor (e.g., temperature sensor 98 shown in FIG. 1). As described above with reference to FIG. 3, if the ambient temperature drops below a threshold, the controller may determine that cold start conditions exist. $A_1$, may therefore represent the threshold temperature, below which cold start conditions may exist. In response to a determination that cold start conditions exist, the fuel pump may be powered on as shown at plot 512 to generate fuel vapors in the fuel tank. Power to the fuel pump may be regulated by the controller based on fueling needs of the engine. Fuel vapor levels in the fuel tank may be estimated based on fuel levels in the tank provided by a fuel level sensor (e.g., fuel level sensor 138 shown in FIG. 2A) and a pressure in the tank provided by a FTPT (e.g., FTPT 191 shown in FIG. 2A). In some examples the fuel vapor levels may be estimated by a hydrocarbon sensor (e.g., hydrocarbon sensor 192 shown in FIG. 2A).

Based on the fuel vapor levels in the fuel tank, and an amount of vacuum in the intake manifold, the fuel vapor flow rate to the intake manifold may be estimated. Fuel vapor flow to the intake manifold may be initiated by opening of the CPV. The position of the CPV may be adjusted by the controller between an open and a closed position as shown at plot 518. When in the closed position, the CPV may fluidically seal the EVAP system from the intake manifold, restricting flow there-between. However, an opening formed by the CPV may increase with increasing deflection of the CPV away from the closed position towards the open position. Flow through the CPV also may be regulated by turning the CPV fully on and fully off at a duty cycle related to a desired vapor flow rate. In some examples, the CPV may be opened, and fuel vapors from the fuel tank may flow to the intake manifold when fuel vapor levels in the fuel tank have reached a threshold. $L_1$ may represent the threshold fuel vapor level, which when reached may trigger the controller to open the CPV, and dump fuel vapors into the intake manifold during an engine cold start.

Starting before $t_1$, the engine may be off. As such, the engine speed may be at lower first level $E_1$, which may be approximately zero. However, in other examples, $E_1$ may represent an engine speed greater than zero. Since the engine is off, fuel injection amount may be at lower first level $I_1$, which may be approximately zero. Further, since fuel is not being injected to the engine cylinders before $t_1$, the air to fuel ratio may be at a higher first level $F_1$. The oxygen sensor temperature may be below the threshold temperature $T_1$, and the ambient temperature may be greater than the threshold temperature $A_1$. The fuel pump may remain off before $t_1$, as fuel injection is not desired. Fuel vapor levels in the fuel tank may remain below the threshold $L_1$, but may be increase before $t_1$, as fuel may evaporate in the tank while the engine remains off. Fuel vapor flow rate may remain at a lower first level $R_1$ before $t_1$ since the CPV may remain closed. Lower first level $R_1$ may represent approximately zero flow of fuel vapors to the intake manifold. However, in other examples $R_1$ may be greater than zero.

At $t_1$, an engine start may occur and thus, the engine speed may begin to increase from the lower first level $E_1$. Specifically, a starter motor (e.g., motor 20 shown in FIG. 1) may provide an initial crank to the engine to begin cylinder combustion. The engine start may occur in response to a key-on event from a vehicle operator (e.g., vehicle operator 132 shown in FIGS. 2A-2B). Since, the ambient temperature is greater than the threshold $A_1$, cold start conditions may not exist, and thus the fuel pump may first be turned on at $t_1$ during the engine start. Further, since the oxygen sensor temperature is below the threshold at $t_1$, a pre-set amount of fuel may be injected to the engine cylinders. Thus, fuel injection amount may increase at $t_1$ from the lower first level $I_1$, to a higher second level $I_2$. Accordingly, the air/fuel ratio may decrease from the higher first level $F_1$. In some examples, the air/fuel ratio may decrease to approximately the lower second level $F_2$. The lower second level $F_2$ may represent an approximately stoichiometric (14.7:1) air to fuel ratio. However, in other examples, the air fuel ratio may run slightly lean, and may be greater than $F_2$. In other examples, the air fuel ratio may run slightly rich, and may be less than $F_2$. The CPV may remain closed during the engine start at $t_1$, and thus the fuel vapor flow rate may remain at the lower first level, $R_1$. Fuel vapor levels in the fuel tank may continue to increase at $t_1$, but may remain below the threshold $L_1$.

Between $t_1$ and $t_2$, the oxygen sensor temperature may continue to increase as exhaust gasses heat the oxygen sensor. However, the temperature may remain below $T_1$, and as such, the fuel injection amount may remain relatively constant around $I_2$. The fuel pump may remain on to provide fuel to one or more fuel injectors (e.g., fuel injector 166 shown in FIGS. 2A-2B). Further, the CPV may remain closed, and thus the fuel vapor flow rate may remain at the lower first level $R_1$. Fuel vapor levels in the fuel tank may continue to increase as fuel evaporates during engine operation. Engine speed may increase between $t_1$ and $t_2$.

At $t_2$, the oxygen sensor may reach the threshold temperature $T_1$. Thus, at $t_2$, the fuel injection amount may be adjusted based on output from the oxygen sensor to achieve a relatively stoichiometric air/fuel ratio. Thus, the air/fuel ratio may fluctuate around $F_2$. The fuel pump may remain on to provide fuel to the one or more fuel injectors. Further, the CPV may remain closed, and thus the fuel vapor flow rate may remain at the lower first level $R_1$. Fuel vapor levels in the fuel tank may continue to increase as fuel evaporates during engine operation. Engine speed may continue to increase at $t_2$.

Between $t_2$ and $t_3$, the engine may remain on, and the engine speed may fluctuate according to a desired torque output. Based on outputs from the oxygen sensor, the air/fuel ratio may be maintained around $F_2$. The fuel pump may remain on to provide fuel to the one or more fuel injectors. Further, the CPV may remain closed, and thus the fuel vapor flow rate may remain at the lower first level $R_1$. Fuel vapor levels in the fuel tank may continue to increase as fuel evaporate during engine operation. Ambient temperature may remain above the threshold $A_1$.

At $t_3$, the engine may be powered off. Thus, the engine speed may decrease to the lower first level $E_1$, and the fuel injection amount may decrease to the lower first level $I_1$. As such, the air/fuel ratio may increase back to the higher first level $F_1$ and the fuel pump may be powered off. The oxygen sensor temperature may remain above the threshold temperature $T_1$ since the sensor may still be hot from the recent engine operation. The fuel pump may remain on to provide fuel to the one or more fuel injectors. Further, the CPV may remain closed, and thus the fuel vapor flow rate may remain at the lower first level $R_1$. Fuel vapor levels in the fuel tank may continue to increase as fuel evaporates continues to evaporate in the fuel tank. However fuel vapor level may remain below the threshold, $L_1$. Engine speed may continue to increase at t2. Ambient temperature may continue to decrease, and may reach the threshold $A_1$ at $t_3$.

Between $t_3$ and $t_4$, the engine may be off. As such, the engine speed may be at the lower first level $E_1$. Since the engine is off, fuel injection amount may be at lower first level $I_1$. Further, since fuel is not being injected to the engine cylinders, the air to fuel ratio may be at a higher first level $F_1$, and the fuel pump may remain off. The oxygen sensor temperature may decrease below the threshold temperature $T_1$, as it is no longer being heated by exhaust gasses. The ambient temperature may continue to decrease below the threshold temperature $A_1$. Fuel vapor levels in the fuel tank may remain below the threshold $L_1$, but may be increase as fuel may evaporate in the tank while the engine remains off. Fuel vapor flow rate may remain at a lower first level $R_1$ since the CPV may remain closed.

At $t_4$ it may be determined that an engine start is imminent. For example, the vehicle operator may send signals to the controller via a display or buttons on a vehicle communication system (e.g., message center 96 shown in FIG. 1). As explained in greater detail above with reference to FIG. 3, the vehicle operator may additionally or alternatively indicate to the controller that an engine start is imminent via commands from a wireless device such as a phone, or by unlocking of the vehicle system via an authentication device (e.g., key). Since the ambient temperature is below the threshold at $t_4$, the controller may determine that cold start conditions exist, and thus the fuel pump may be turned on at $t_4$, prior to the engine start at $t_5$, to generate additional vapors in the fuel tank. Because of the spinning of the fuel pump, the amount of fuel vapors in the fuel tank may increase at a faster rate at $t_4$. Since the engine is off at $t_4$, the engine speed may be at the lower first level $E_1$. Fuel injection amount may be at lower first level $I_1$, and thus, the air to fuel ratio may be at a higher first level $F_1$. Fuel vapor flow rate may remain at a lower first level $R_1$ since the CPV may remain closed.

Between $t_4$ and $t_5$, the fuel pump may remain on prior to the engine start at t5, to generate additional vapors in the fuel tank. Because of the spinning of the fuel pump, the amount of fuel vapors in the fuel tank may increase at a faster rate at between $t_4$ and $t_5$, than before $t_4$. Since the engine is off, the engine speed may be at the lower first level $E_1$. Fuel injection amount may be at lower first level $I_1$, and thus, the air to fuel ratio may be at a higher first level $F_1$. Fuel vapor flow rate may remain at the lower first level $R_1$ since the CPV may remain closed. Ambient temperature may remain below $A_1$, and the oxygen sensor temperature may remain below $T_1$.

At $t_5$, the fuel vapor levels in the fuel tank may reach the threshold $L_1$. In response to the fuel vapors reach the threshold level at $t_5$, an engine start may be initiated. Specifically in some examples, the vehicle operator may be instructed to turn on the engine. However, in other examples, the controller may crank the engine with the starter motor. Thus, at $t_5$, the engine may be cranked by the starter motor, and thus engine speed may being to increase above the lower first level $E_1$. Fuel injection may be increased from the lower first level $I_1$ initiate cylinder combustion. Since, the oxygen sensor temperature may remain below the threshold $T_1$, a pre-set amount of fuel may be injected to the engine cylinders. However, the fuel injection amount may be increased to an amount below $I_2$, or greater than $I_2$ to achieve a leaner than, or richer than stoichiometric air/fuel ratio during the cold start at $t_5$. By running a leaner than or richer than stoichiometric air/fuel ratio during the cold start at $t_5$, the exhaust gas temperatures may be increased to enhance heating of the oxygen sensor and an exhaust catalyst (e.g., catalyst 170 shown in FIGS. 2A-2B). As such, the air/fuel ratio may decrease from the higher first level $F_1$ at $t_5$. However, as shown at plot 506, in examples where the engine is run with a leaner than stoichiometric air/fuel mixture, the air/fuel ratio may be greater than $F_2$ a $t_5$. Fuel vapor flow rate may remain at the lower first level $R_1$ since the CPV may remain closed. Ambient temperature may remain below $A_1$. The fuel pump may remain on to provide fuel to the fuel injectors. Further, fuel vapor levels may continue to increase above the threshold $L_1$.

Between $t_5$ and $t_6$, the oxygen sensor temperature may continue to increase as exhaust gasses heat the oxygen sensor. However, the temperature may remain below $T_1$, and as such, the fuel injection amount may remain relatively constant. The fuel pump may remain on to provide fuel to the one or more fuel injectors. Engine speed may continue to increase above $E_1$, but remain below $E_2$. $E_2$ may represent an engine speed at which vacuum levels in the intake manifold may reach levels sufficient to draw in fuel vapors from the fuel tank and/or fuel vapor canister (e.g., canister 122 shown in FIG. 2A). Thus, when engine speeds are less than $E_2$, the vacuum level in the intake manifold may not be sufficient to draw in the fuel vapors from the fuel tank and/or canister. As such, the CPV may remain closed, and thus the fuel vapor flow rate may remain at the lower first level $R_1$. Fuel vapor levels in the fuel tank may continue to increase as fuel evaporates during engine operation. Ambient temperature may continue to fluctuate below the threshold $A_1$.

At $t_6$, the engine speed may reach the threshold $E_2$. In some examples, the threshold may be approximately 200 rpm. However, in other examples, the threshold may be greater than or less than 200 rpm. In response to the engine speed reaching the threshold $E_2$ at $t_6$, the CPV may be adjusted from the closed position to the open position. Additionally, a fuel tank isolation valve (e.g., FTIV 152 shown in FIG. 2A) and a canister vent valve (e.g., CVV 129 shown in FIG. 2A) may be opened to increase fuel vapor flow rate to the intake manifold. Due to the opening of the CPV, and one or more of the FTIV and CVV, the fuel vapor flow rate to the intake manifold may increase from the lower first level $R_1$, to a higher second level $R_2$. In response to the increase in fuel vapor flow rate to the intake manifold, the fuel injection amount may be reduced from around $I_2$, to a lower level. In some examples, the fuel injection amount may be reduced all the way to $I_1$. The fuel pump may remain on to provide fuel to the one or more fuel injectors. Ambient temperature may continue to fluctuate below the threshold $A_1$. The oxygen sensor temperature may remain below $T_1$, but may steadily increase due to cylinder combustion.

Between $t_6$ and $t_7$, the oxygen sensor temperature may remain below the threshold $T_1$. As such, fuel injection may not be adjusted based on outputs from the oxygen sensor. However, fuel injection amount may be adjusted based on the fuel vapor flow rate to the intake manifold. Specifically, the fuel injection amount may be inversely proportional to the fuel vapor flow rate. Since the CPV may be maintained open between $t_6$ and $t_7$, the fuel vapor levels in the fuel tank may decrease as fuel vapors are purged to the intake manifold. As the fuel vapor levels in the fuel tank decrease, the fuel vapor flow rate may correspondingly decrease between $t_6$ and $t_7$. In response to the decrease in fuel vapor flow rate, the fuel injection amount may be increased. As such, the fuel pump may remain on. Ambient temperature may remain below $A_1$. Engine speed may continue to increase above $E_2$.

At $t_7$, the oxygen sensor temperature may reach the threshold $T_1$, and thus the fuel injection amount may be adjusted based on outputs from oxygen sensor to achieve a relatively stoichiometric air/fuel ratio. Thus, the fuel pump may remain on. The CPV may be closed at $t_7$, and thus the fuel vapor level in the fuel tank may stabilize. Further, the fuel vapor flow rate may decrease to the lower first level $R_1$. The ambient temperature may begin to increase above the threshold $A_1$. Engine speed may continue to fluctuate above $E_2$.

After $t_7$, the oxygen sensor temperature may continue to fluctuate above $T_1$, and thus the fuel injection amount may be adjusted based on outputs from oxygen sensor to achieve a relatively stoichiometric air/fuel ratio. Thus, the fuel pump may remain on. The CPV may remain closed, and thus the fuel vapor level in the fuel tank may increase. Further, the fuel vapor flow rate may remain at the lower first level $R_1$. The ambient temperature may continue to increase above the threshold $A_1$. Engine speed may continue to fluctuate above $E_2$.

In this way, hydrocarbons emissions during an engine start may be reduced. In response to signals received from a vehicle operator to initiate an engine start, and a determination that cold start conditions exist, a fuel pump may of a fuel tank may be powered on to generate vapors in the fuel tank prior to the engine start. Once the fuel vapors in the fuel tank reach a threshold, the vehicle operator may be instructed to turn on the engine. In other examples, a vehicle controller may turn on the engine in response to the fuel vapor levels in the fuel tank reaching the threshold level.

Turning on the engine may comprise providing electrical power from a vehicle battery to a starter motor, and cranking the engine with the starter motor to provide initial suction for drawing in a fuel and air mixture to one or more engine cylinders to initiate cylinder combustion. In response to the engine speed reaching a threshold speed, the controller may open a canister purge valve, and one or more of a fuel tank isolation valve and a canister vent valve, to purge fuel vapors from the fuel tank and a fuel vapor storage canister to the intake manifold. In this way, an amount of fuel vapors delivered to the engine cylinders during an engine start may be increased.

Due to the increase in fuel vapors flowing to the intake manifold upon opening of the CPV, an amount of fuel injected to the engine cylinders may be reduced. Specifically, the fuel injection amount during the engine start may be inversely proportional to the fuel vapor flow rate. That is to say that the amount of fuel injected to the engine cylinders may monotonically decrease for monotonic increases in the fuel vapor flow rate from one or more of the fuel tank and canister.

In some examples, the engine may include an exhaust oxygen sensor for providing an indication of the air/fuel ratio of the mixture provided to the engine cylinders. However, the oxygen sensor may not generate voltage outputs until heated to a threshold temperature. In this way, prior to the exhaust oxygen sensor reaching the threshold temperature where the fuel injection amount may be adjusted based on outputs from the oxygen sensor, the fuel injection amount may be adjusted based on the fuel vapor flow rate to the intake manifold.

However, once the oxygen sensor has reached the threshold temperature, and the air/fuel ratio may be estimated based on outputs from the sensor, the fuel injection amount may be adjusted to achieve a relatively stoichiometric air/fuel ratio. One or more of the fuel injection amount and fuel vapor flow rate from the fuel tank and canister to the intake manifold may be adjusted to achieve the stoichiometric air/fuel ratio. The fuel vapors flow rate may be adjusted by adjusting the position of the CPV and one or more of the CVV and FTIV.

A first technical effect of reducing emissions during engine starts is achieved by purging fuel vapors from the fuel tank and/or canister to the intake manifold during the engine start. As explained above, the amount of liquid fuel injected during the engine start may be reduced by providing a portion of the fuel budget desired during an engine start in the form of fuel vapor. Thus, depending on the fuel vapor flow rate to the intake manifold, the fuel vapors may either supplement, or completely replace liquid fuel injection during a portion of an engine start. Since fuel vapors may combust more readily than liquid fuel, especially at lower temperatures, the combustion efficiency of the engine during the start may be increased. That is to say that, a more complete burning of hydrocarbons is achieved during an engine start. In this way, fewer unburnt hydrocarbons may be exhausted by the engine, therefore reducing emissions during the engine start.

Additionally, exhaust gas temperatures may be increased during the engine start due to the higher combustion efficiency achieved from the added fuel vapors. In this way, an exhaust catalyst may be heated more quickly. Thus, the efficiency of the exhaust catalyst during an engine start may be increased, further reducing emissions during the engine start.

Another technical effect of improving engine start reliability may be achieved by running a fuel pump prior to the engine start to generate vapors in the fuel tank which may be released to the intake manifold during the engine start. Spinning the fuel pump prior to the engine start may not only generate vapors in the fuel tank which may be used during an engine start, but it may also increase the temperature of the liquid fuel in the fuel tank. Since fuel vapors may combust more readily than liquid fuel, the success rate of engine starts may be improved by purging fuel vapors from the fuel tank to the intake manifold during the engine start. Further, since liquid fuel may be more volatile at higher temperatures, the success rate of engine starts may be increased by running the fuel pump prior to the engine start and increasing liquid fuel temperature. Put more simply, the volatility of fuel provided to the engine cylinders during a start may be increased by increasing the temperature of the liquid fuel injected to the cylinders, and by routing fuel vapors from the fuel tank to the engine cylinders. By providing the engine cylinders with a more volatile air/fuel mixture, engine start failures may be reduced.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

prior to an engine cold start:

sealing a fuel tank from an evaporative emissions control system and an air intake of an engine;

operating a fuel pump of the fuel tank to generate vapors in the fuel tank; and in response to both fuel vapor levels in the fuel tank and an engine speed reaching respective thresholds:

initiating cylinder combustion and flowing fuel vapors from the fuel tank to an engine intake manifold.

2. The method of claim 1, wherein the sealing the fuel tank comprises closing a fuel tank isolation valve positioned between the fuel tank and the intake manifold.

3. The method of claim 1, wherein the initiating cylinder combustion comprises cranking the engine with a starter motor and injecting liquid fuel to the engine.

4. The method of claim 1, wherein the fuel vapor levels are estimated based on a pressure in the fuel tank and a fuel level in the fuel tank, where the pressure is estimated based on outputs from a pressure sensor coupled to the fuel tank and the fuel level is estimated based on outputs from a fuel level sensor positioned within the fuel tank.

5. The method of claim 4, further comprising prior to an exhaust oxygen sensor reaching a threshold temperature, delivering a desired starting amount of fuel to the engine, the desired starting amount of fuel including one or more of liquid fuel and fuel vapors, where an amount of liquid fuel injected to the engine is inversely proportional to an amount of fuel vapors flowing to the intake manifold.

6. The method of claim 5, wherein the amount of fuel vapors flowing to the intake manifold is estimated based on the fuel vapor levels in the fuel tank and a vacuum level in the intake manifold is estimated based on outputs from a pressure sensor coupled to the intake manifold.

7. The method of claim 1, further comprising after an exhaust oxygen sensor reaches a threshold temperature, adjusting one or more of a fuel injection amount via fuel injectors and an amount of fuel vapors flowing to the intake manifold by adjusting a position or duty cycle of a canister purge valve, to achieve a stoichiometric air to fuel ratio, where the amount of fuel vapors flowing to the intake manifold is estimated based on outputs from the exhaust oxygen sensor.

8. The method of claim 1, wherein the flowing fuel vapors from the fuel tank to the intake manifold comprises opening a canister purge valve positioned in a purge line, the purge line providing fluidic communication between the fuel tank and the intake manifold.

9. The method of claim 1, wherein the fuel vapors from the fuel tank are routed to the intake manifold during an engine start after one or more prior attempts to start the engine without the routing of the fuel vapors to the intake manifold.

10. The method of claim 1, wherein the fuel vapors from the fuel tank continue to be delivered to the intake manifold after initiating cylinder combustion.

11. A method comprising:

prior to a cold start of an engine:

sealing a fuel tank from an evaporative emissions control system and an air intake of the engine; and operating a fuel pump of the fuel tank to generate vapors in the fuel tank; and cranking the engine with a starter motor, and in response to engine speed reaching a threshold, opening a canister purge valve (CPV) and flowing fuel vapors from the fuel tank and a fuel vapor storage canister to an intake manifold of the engine.

12. The method of claim 11, further comprising during the cold start and prior to an exhaust oxygen sensor reaching a threshold temperature, providing a desired amount of fuel to the engine, the desired amount of fuel comprising one or more of liquid fuel injected from one or more fuel injectors and fuel vapors from the fuel tank and canister.

13. The method of claim 12, further comprising prior to the engine speed reaching the threshold, injecting liquid fuel in an amount equivalent to the desired amount of fuel to one or more engine cylinders while cranking the engine to initiate cylinder combustion.

14. The method of claim 13, further comprising reducing the amount of liquid fuel injected to the one or more engine cylinders from the desired amount in response to the opening of the canister purge valve, where the amount that the liquid fuel is reduced is proportional to an amount of fuel vapors flowing to the intake manifold, so that the desired amount of fuel continues to be provided to the engine prior to the exhaust oxygen sensor reaching the threshold temperature.

15. The method of claim 11, further comprising not injecting liquid fuel to the engine prior to the engine speed reaching the threshold, and initiating cylinder combustion once the engine speed has reached the threshold by igniting the fuel vapors from the fuel tank and fuel vapor storage canister via a spark from a spark plug.

16. The method of claim 11, further comprising turning off the fuel pump prior to the engine cold start in response to a state of charge of a vehicle battery decreasing below a threshold.

17. The method of claim 11, further comprising opening a fuel tank isolation valve and a canister vent valve in response to the engine speed reaching the threshold.

18. The method of claim 11, further comprising heating the fuel vapor storage canister with a heater coupled to the canister prior to opening of the CPV.

19. The method of claim 11, wherein the threshold engine speed represents an engine speed at which a vacuum level in the intake manifold is sufficient to draw in fuel vapors from the fuel tank and canister.

20. An engine system comprising:

a fuel tank for storing liquid fuel;

fuel injectors for injecting the liquid fuel to one or more engine cylinders;

a fuel pump included in the fuel tank and configured to pump liquid fuel from the fuel tank to the fuel injectors; and a controller with computer readable instructions for:

sealing the fuel tank and operating the fuel pump to generate fuel vapors in the fuel tank prior to a cold start of the engine system; and routing fuel vapors in the fuel tank to the one or more engine cylinders during the cold start in response to an engine speed reaching a threshold.

* * * * *